US009164418B2

(12) United States Patent
Sakuma et al.

(10) Patent No.: US 9,164,418 B2
(45) Date of Patent: Oct. 20, 2015

(54) DEVELOPING DEVICE, AND IMAGE FORMING APPARATUS USING THE SAME

(71) Applicant: FUJI XEROX CO., LTD., Tokyo (JP)

(72) Inventors: Masaru Sakuma, Kanagawa (JP); Munenobu Okubo, Kanagawa (JP); Shinji Mitsui, Kanagawa (JP); Yasuyuki Tsutsumi, Kanagawa (JP); Kazuaki Iikura, Kanagawa (JP); Yosuke Ninomiya, Kanagawa (JP); Yoshifumi Ozaki, Kanagawa (JP); Akihiko Noda, Kanagawa (JP); Hirokazu Hamano, Kanagawa (JP); Takafumi Wakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 181 days.

(21) Appl. No.: 13/874,822

(22) Filed: May 1, 2013

(65) Prior Publication Data

US 2014/0147142 A1 May 29, 2014

(30) Foreign Application Priority Data

Nov. 27, 2012 (JP) ..... 2012-259180

(51) Int. Cl.
*G03G 15/08* (2006.01)

(52) U.S. Cl.
CPC ..... *G03G 15/0808* (2013.01); *G03G 15/0891* (2013.01)

(58) Field of Classification Search
USPC ..... 399/53, 119, 257, 258, 262, 284
See application file for complete search history.

(56) References Cited

U.S. PATENT DOCUMENTS

| | | | | |
|---|---|---|---|---|
| 7,095,966 | B2 * | 8/2006 | Adachi | 399/27 |
| 2009/0067887 | A1 | 3/2009 | Fujita et al. | |
| 2010/0061749 | A1 * | 3/2010 | Hagiwara et al. | 399/55 |

FOREIGN PATENT DOCUMENTS

| | | |
|---|---|---|
| JP | A-2009-069367 | 4/2009 |

* cited by examiner

*Primary Examiner* — Hoang Ngo
(74) *Attorney, Agent, or Firm* — Oliff PLC

(57) ABSTRACT

There is provided a developing device including a toner holding member that is rotatably provided to face an image holding member and holds and transports a nonmagnetic single-component toner toward a development region to develop an electrostatic latent image on the image holding member, a supplying member that is rotatably provided in elastic contact with the toner holding member to supply the toner from a contact region therebetween to the toner holding member, a toner replenishing unit that faces a replenishment region at a portion apart from the contact region to replenish a new toner, and a regulating member that is provided on a downstream side of the contact region in a rotation direction thereof and on an upstream side of the development region to triboelectrically charge the toner held on the toner holding member and regulate the amount of toner provided for the development.

20 Claims, 15 Drawing Sheets

| | EXAMPLE 1 | COMPARATIVE EXAMPLE 1 | COMPARATIVE EXAMPLE 2 | COMPARATIVE EXAMPLE 3 |
|---|---|---|---|---|
| NEW TONER ENTERING POSITION | HORIZONTAL (0°) | OBLIQUELY UPWARD (21°) | OBLIQUELY UPWARD (50°) | UPWARD (86°) |
| SECTIONAL VIEW |   |  |  |  |
| MIXTURE PREVENTION | ○ | × | × | × |
| SUPPLYING CAPABILITY | ○ | ○ | ○ | ○ |

GOOD

DEVELOPING DEVICE, AND IMAGE FORMING APPARATUS USING THE SAME

CROSS-REFERENCE TO RELATED APPLICATIONS

This application is based on and claims priority under 35 USC 119 from Japanese Patent Application No. 2012-259180 filed Nov. 27, 2012.

BACKGROUND

Technical Field

The present invention relates to a developing device, and an image forming apparatus using the same.

SUMMARY

According to an aspect of the invention, there is provided a developing device including a toner holding member that is rotatably provided to face an image holding member, which circulates while holding an electrostatic latent image, and holds and transports a nonmagnetic single-component toner toward a development region, which is opposed to the image holding member, so as to develop the electrostatic latent image on the image holding member, a supplying member that has a rough surface, on which the toner may be captured, on a circumferential surface of an elastic member which is elastically deformable, and is rotatably provided in elastic contact with the toner holding member so as to supply the toner from a contact region, which comes into contact with the toner holding member, to the toner holding member, a toner replenishing unit that faces a replenishment region at a portion apart from the contact region of the supplying member, which comes into contact with the toner holding member, so as to replenish a new toner, and a regulating member that is provided on a downstream side of the contact region, which comes into contact with the supplying member, in the toner holding member in a rotation direction thereof and on an upstream side of the development region of the toner holding member in a rotation direction thereof so as to triboelectrically charge the toner held on the toner holding member and regulate the amount of toner provided for the development, in which in the toner replenishing unit, a containing chamber, which contains the new toner such that the toner may be replenished, is connected to a developing chamber, wherein the supplying member and the toner holding member are disposed, through a toner transporting path, wherein a developing chamber side opening of the toner transporting path is positioned below a containing chamber side opening of the toner transporting path, and is disposed to face a region under a rotation center of the supplying member, and wherein the supplying member rotates from a down side thereof toward an upper side thereof at a portion facing the developing chamber side opening of the toner transporting path.

BRIEF DESCRIPTION OF THE DRAWINGS

Exemplary embodiments of the present invention will be described in detail based on the following figures, wherein.

DETAILED DESCRIPTION

Brief Overview of Exemplary Embodiment

Figure 1A:
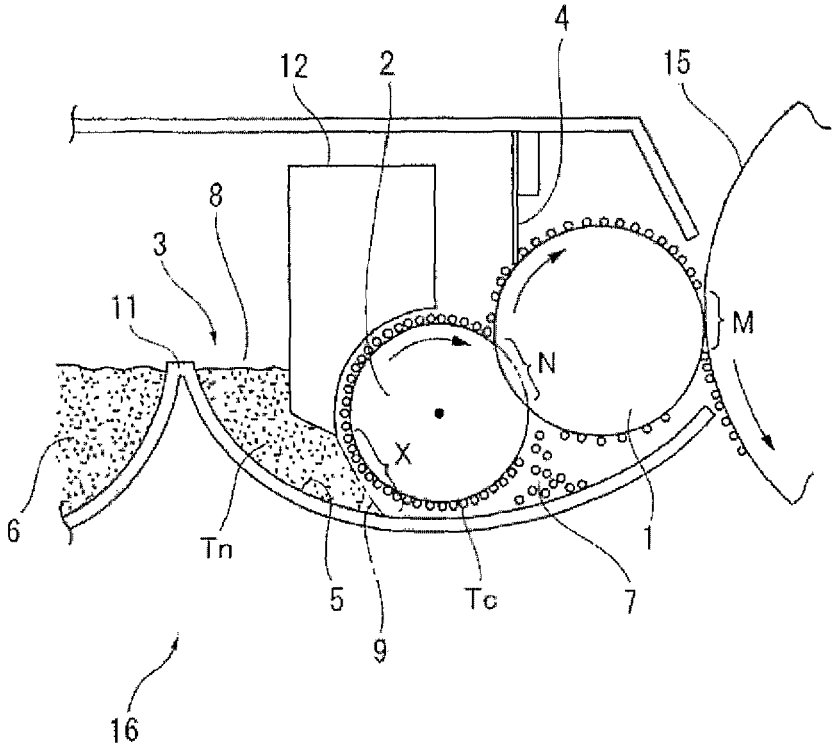
FIG. 1A is an explanatory diagram illustrating a brief overview of an exemplary embodiment of an image forming apparatus including a developing device according to the present invention.

FIG. 1A is an explanatory diagram illustrating a brief overview of an exemplary embodiment of an image forming apparatus including a developing device according to the present invention.

In the drawing, the image forming apparatus includes an image holding member 15 that circulates while holding an electrostatic latent image, and a developing device 16 that is disposed to face the image holding member 15 and develops the electrostatic latent image on the image holding member 15.

Figure 1B:
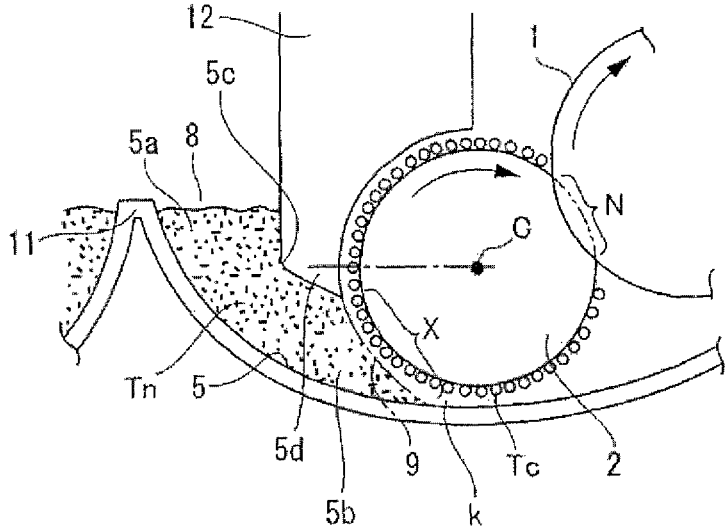
FIG. 1B is an explanatory diagram illustrating a correlation between a toner transporting path and a supplying member.

In addition, as shown in FIGS. 1A and 1B, the developing device 16 used in the present exemplary embodiment includes: a toner holding member 1 that is rotatably provided to face the image holding member 15, which circulates while holding the electrostatic latent image, and holds and transports a nonmagnetic single-component toner toward a development region M opposed to the image holding member 15 so as to develop the electrostatic latent image on the image holding member 15; a supplying member 2 that has a rough surface, on which the toner may be captured, on a circumferential surface of an elastic member which is elastically deformable, and is rotatably provided in elastic contact with the toner holding member 1, so as to supply the toner from a contact region N, which comes into contact with the toner holding member 1, to the toner holding member 1; a toner replenishing unit 3 that faces a replenishment region X at the portion apart from the contact region N of the supplying member 2, which comes into contact with the toner holding member 1, so as to replenish a new toner; and a regulating member 4 that is provided on the downstream side of the contact region N, which comes into contact with the supplying member 2, in the toner holding member 1 in the rotation direction and on the upstream side of the development region M of the toner holding member 1 in a rotation direction thereof so as to triboelectrically charge the toner held on the toner holding member 1 and regulate the amount of toner provided for the development. In the toner replenishing unit 3, a containing chamber 6, which contains the new toner Tn such that the toner may be replenished, is connected to a developing chamber 7, in which the supplying member 2 and the toner holding member 1 are disposed, through a toner transporting path 5, and a developing chamber side opening 9 of the toner transporting path 5 is positioned below a containing chamber side opening 8 of the toner transporting path 5, and is disposed to face a region under a rotation center (the center position is indicated by C) of the supplying member 2. The supplying member 2 rotates from a down side thereof toward an upper side thereof at a portion facing the developing chamber side opening 9 of the toner transporting path 5.

In such a technical unit, any type of the toner holding member 1 may be used when it holds the toner and provides the toner to the development region M between itself and the image holding member 15.

Further, the supplying member 2 may rotate in a direction opposite to the toner holding member 1 at the portion opposed thereto, and may rotate in the same direction. Here, in the case where the members rotate in the same direction, a difference in speed between both of them is necessary to supply the toner from the supplying member 2 to the toner holding member 1. Furthermore, the supplying member 2 may have a rough surface (unevenness) for capturing the toner on the circumferential surface thereof, and a typical example thereof is a foam, but for example an elastic rubber, on which concave portions such as grooves are formed on the circumferential surface thereof, may be used. Moreover, the foam may be either interconnected cell foam or independent cell foam, but the interconnected cell foam is preferable in view of softness and costs.

In addition, any type of the toner replenishing unit 3 may be used when it replenishes the new toner Tn in the predetermined replenishment region X on the supplying member 2, and the replenishment region X of the supplying member 2 is replenished with the new toner Tn of the containing chamber 6 through the toner transporting path 5 by providing the containing chamber 6 of the new toner Tn in the vicinity of the supplying member 2.

Here, the replenishment region X determined by the toner replenishing unit 3 is set as a portion apart from the contact region N between the toner holding member 1 and the supplying member 2. The reason is to actively prevent the old and new toners from being mixed on the supplying member 2 when the new toner Tn is directly supplied to the contact region N between the toner holding member 1 and the supplying member 2 by the toner replenishing unit 3.

Further, the regulating member 4 triboelectrically charges the toner which is held on the toner holding member 1, and regulates the amount of toner to a predetermined amount. The regulating member 4 is typically a plate-like member that extends to face the toner holding member 1 in the rotation direction of the toner holding member 1 and comes into elastic contact therewith, but is not limited to this, and a rotating member or the like may be used. Since the toner supplied from the supplying member 2 to the toner holding member 1 is triboelectrically charged by the regulating member 4, in a situation where the new toner Tn and the old toner Tc with different charging characteristics are mixed, the charge amounts of the old and new toners have large variation, and the charge distribution thereof spreads. On this point, in a situation where most of the toner captured on the supplying member 2 is the old toner Tc, the charging characteristics thereof are substantially the same, and thus there is no possibility of the variation of the charge amounts and the spreading of the charge distribution.

Furthermore, the toner replenishing unit 3 is limited to the configuration in which there is provided the toner transporting path 5 having a predetermined structure. However, the shape of the toner transporting path 5 may be appropriately set as a linear shape, a bend shape, a curved shape, or the like insofar as the following prerequisites are satisfied.

Here, "the developing chamber side opening 9 of the toner transporting path 5 is positioned below the containing chamber side opening 8" is a prerequisite for causing the new toner Tn to remain in the toner transporting path 5 by its own weight.

Moreover, the following effects are obtained on the basis of the prerequisites "the toner transporting path 5 is disposed to face the region under the rotation center of the supplying member 2", and "the supplying member 2 rotates from the bottom toward the top at the portion facing the developing chamber side opening 9 of the toner transporting passage 5.

That is, in the present configuration, the new toner Tn is filled in the toner transporting path 5 in a state where the toner remains therein, and the toner remaining portion of the new toner Tn is disposed to face the supplying member 2 by its own weight. Hence, an interface (as a wall) is formed between the toner remaining portion of the new toner Tn and the circumferential surface of the supplying member 2. Accordingly, the following behavior may be inferred: the supplying member 2 is not replenished with the new toner Tn at the location, at which the old toner Tc is captured, on the circumferential surface of the supplying member 2, and is replenished with the new toner Tn only at the location, at which the old toner Tc is not captured, on the circumferential surface of the supplying member 2. Further, the old toner To, which is captured on the supplying member 2, is pressed at the toner remaining portion of the new toner Tn, and thus the old toner Tc, which is captured on the supplying member 2, is less likely to leak into the toner remaining portion of the new toner Tn.

Hence, for example, when the separated toner which is separated in the contact region N between the toner holding member 1 and the supplying member 2 is adhered onto the supplying member 2 and transported again, the separated toner is not mixed with the new toner Tn in the toner remaining portion, and is moved along the interface k of the toner remaining portion of the new toner Tn. Thus, the old toner Tc, which is adhered onto the supplying member 2, is transported again in preference to the new toner Tn by the supplying member 2, and is provided for development.

Furthermore, when the preferentially re-transported toner is provided for development in the development region M of the image holding member 15, the amount of toner (corresponding to the amount of re-transported toner) adhered around the supplying member 2 is reduced, and the portion of the circumferential surface of the supplying member 2, in which the re-transported toner is reduced, is recessed. When the recessed portion passes in front of the developing chamber side opening 9 of the toner transporting path 5, the recession on the circumferential surface of the supplying member 2 is autonomously replenished with the new toner Tn from the toner remaining portion of the new toner Tn.

In addition, when the developing chamber side opening 9 of the toner transporting path 5 is formed to reach a region above the rotation center of the supplying member 2, or when the rotation direction of the supplying member 2 is a backward direction, the interface k of the toner remaining portion of the new toner Tn tends to be drawn by the rotation of the supplying member 2, and thus a large amount of the new toner Tn is likely to be unnecessarily transported through the supplying member 2.

Next, a typical configuration or a preferable configuration of the developing device will be described.

First, in a preferable configuration of the toner transporting path 5, the lower end of the containing chamber side opening 8 of the toner transporting path 5 is positioned below the portion in which the toner is regulated by the regulating member 4.

In the present configuration, the toner, which is present in the developing chamber 7, is pushed by the own weight of the toner remaining portion of the new toner Tn within the toner transporting path 5, but the toner within the developing chamber 7 is not increased up to the toner regulating portion of the regulating member 4, and thus the regulating member 4 is tightly pressed by the toner within the developing chamber 7. As a result, there is no adverse effect on the regulating operation which is performed by the regulating member 4.

Further, in another preferable configuration of the toner transporting path 5, there are provided a longitudinal passage 5*a*, which extends in the longitudinal direction along the substantially vertical direction, and a lateral passage 5*b* which is bent from the longitudinal passage 5*a* and extends in the lateral direction toward the supplying member 2.

In the present example, as the height of the longitudinal passage 5*a* increases, the pressure, applied to the circumferential surface of the supplying member 2 at the interface (as a wall) by the toner remaining portion of the new toner Tn, increases. Further, the lateral passage 5*b* is curved and extends in a desired direction from the longitudinal passage 5*a* such that the interface k is formed by the toner remaining portion of the new toner Tn at the portion opposed to the circumferential surface of the supplying member 2.

In a more preferable configuration of the present configuration, a bend portion from the longitudinal passage to the lateral passage is formed in a curved shape. In this case, the bend portion 5*c* between the longitudinal passage 5*a* and the lateral passage 5*b* may be formed in a curved shape, thereby minimizing the moving resistance of the new toner Tn which remains in the range from the longitudinal passage 5*a* to the lateral passage 5*b*.

Further, in another preferable configuration of the present configuration, in the toner transporting path 5, an upper wall 5*d*, which partitions an upper side of the lateral passage 5*b*, is inclined obliquely downward from the longitudinal passage 5*a* toward the supplying member 2, and an inclination angle to the lateral direction is set to be equal to or less than an angle of repose of a used toner. Here, the angle of repose of the toner is an indicator representing the fluidity. In the present configuration, the inclination angle of the upper wall of the lateral passage 5*b* is set to be equal to or less than the angle of repose of the toner in the lateral direction. Hence, correspondingly, the toner particles in the toner remaining portion of the new toner Tn filled in the lateral passage 5*b* are unlikely to flow, and there is an effect to relax the excess pressure from the longitudinal passage 5*a*. Thus, it is possible to adjust the supply pressure applied to the supplying member 2 of the new toner Tn on the basis of the combination between the inclination angle, the length of the lateral passage 5*b*, and the height of the longitudinal passage 5*a*.

Furthermore, in a typical configuration of the toner transporting path 5, the toner transporting path 5 and the containing chamber 6 are divided by the first division member 11, the toner transporting path 5 and the developing chamber 7 are divided by the second division member 12, and the toner transporting path 5 is formed between both of the division members 11 and 12.

According to the present configuration, it is possible to regulate the amount of the new toner Tn, which remains in the toner transporting path 5, by adjusting the height of the first division member 11 and the occupation volume of the second division member 12. In addition, each of the division members 11 and 12 is also able to regulate the capacity of the developing chamber around the toner holding member 1 or the supplying member 2.

Further, in a preferable configuration of the image forming apparatus including such a type of the developing device 16, the control device (not shown in the drawing) capable of controlling consumption of the toner is additionally provided.

Such a type of the control device includes, for example: a calculating section which calculates the amount of toner consumed in image forming performed a predetermined times; a determining section which determines whether or not the amount of toner calculated in the calculating section is greater than or equal to a predetermined threshold value; an ejecting section which ejects the developer within the developing device 16 toward the image holding member 15 by a predetermined amount when the amount of toner determined in the determining section is less than the threshold value; and a cleaning processing section that cleans the toner, which is ejected from the ejecting section, on the image holding member 15.

In the present configuration, considering that the toner tends to be deteriorated since the old toner on the supplying member 2 is not consumed and remains when the amount of consumed toner is small, an object of the configuration is to stabilize the development quality by detecting the deteriorated toner in advance and removing the toner.

Here, in a typical configuration of the calculating section for the amount of consumed toner, it is possible to calculate the amount of consumed toner on the basis of image density. The number of times an image is formed may be calculated by counting the number of output sheets of the recording material converted into the reference size, and may be calculated by counting the driving time of the developing device. Further, the threshold value provided for determination may be calculated as a limit value (lower limit tolerance), which does not cause, for example, development defects, in advance by the experiment and the like. Furthermore, in the ejecting section, under the condition where the development defects are highly likely to occur, the toner captured on the supplying member 2 is regarded as the deteriorated toner. Accordingly, any type of the toner ejecting section may be used when it forcedly ejects the toner from the developing device 16, and ejects the toner typically in a way of forming an electrostatic latent image for ejecting the toner to the image holding member 15 and developing the image. In addition, the image, which is formed on the basis of the ejection operation, is not particularly limited, but may be a beta image, and may be a different image. Further, a different image may be used in accordance with the amount of consumed toner. However, it is necessary to eject a large amount of toner when the amount of consumed toner is small. Furthermore, in a general configuration of the cleaning processing section, a cleaning unit on the image holding member 15 side is used. However, the cleaning processing section is not limited to this, but may give an output onto a recording material, and a different cleaning component may be separately provided.

Hereinafter, on the basis of the exemplary embodiment shown in the accompanying drawings, the present invention will be described in detail.

Exemplary Embodiment 1

Overall Configuration of Image Forming Apparatus

Figure 2:
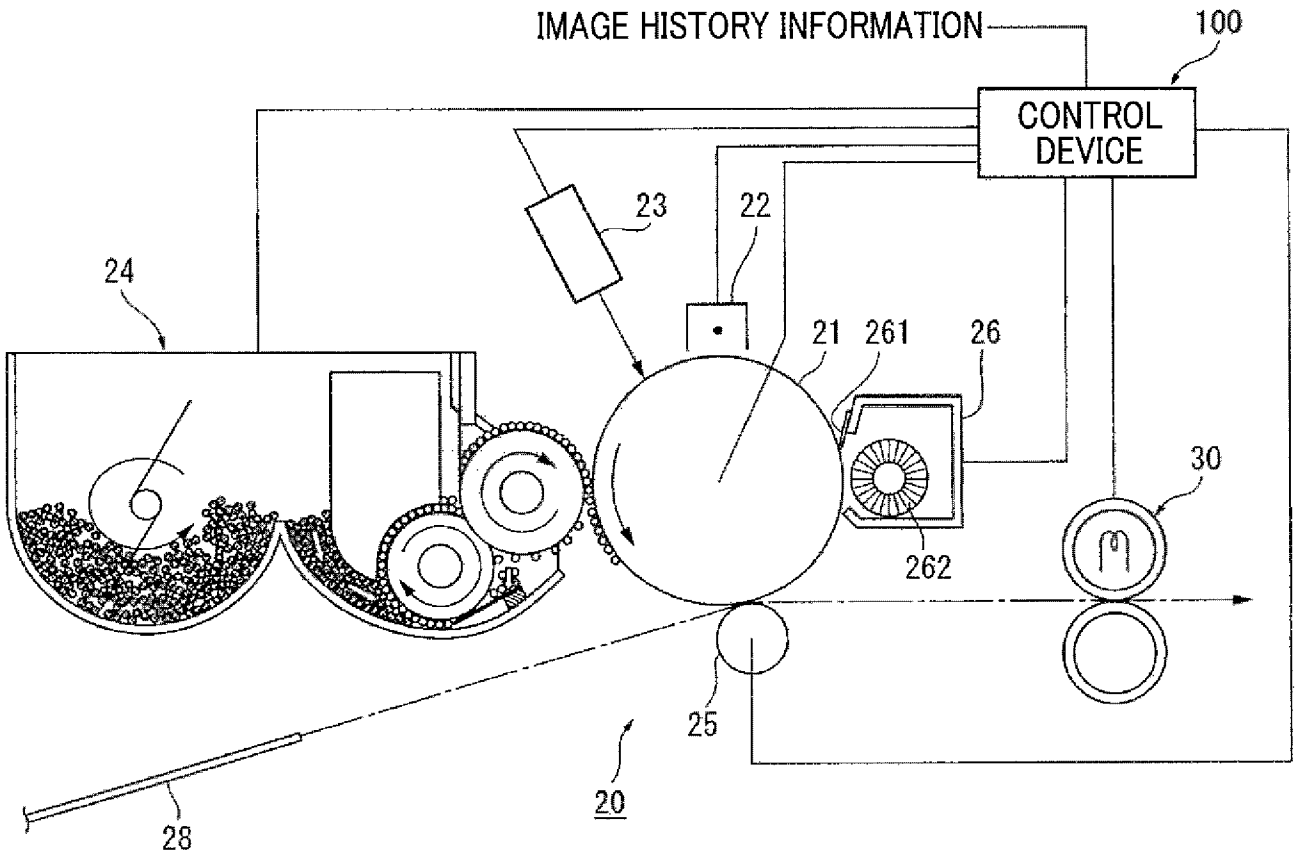
FIG. 2 is an explanatory diagram illustrating an overall configuration of an image forming apparatus according to Exemplary Embodiment 1.

FIG. 2 is an explanatory diagram illustrating an overall configuration of an image forming apparatus according to Exemplary Embodiment 1.

In the same drawing, the image forming apparatus 20 includes: a drum-like photoconductor 21 as an image holding member; a charging device 22 that charges the photoconductor 21; an exposure device 23 that writes the electrostatic latent image onto the photoconductor 21, which is electrically charged by the charging device 22, with light; a developing device 24 that visualizes the electrostatic latent image, which is written onto the photoconductor 21, in the developer (toner); a transfer device 25 that transfers the toner image, which is visualized in the developing device 24, onto a recording material 28 as a transfer medium; and a cleaning device 26 that cleans the remaining toner which is transferred by the transfer device 25 and remains on the photoconductor 21.

In addition, in the present example, the transfer image, which is transferred onto the recording material 28, is fixed by the fixing unit 30 and discharged. Further, the reference number 100 represents a control device that controls the components of the image forming apparatus 20. In addition, in the present example, the recording material 28 is exemplified as a transfer medium. However, the material is not limited to this, and may include an intermediate transfer body that temporarily holds the toner image before transferring the toner image onto the recording material 28.

Here, the photoconductor 21 is configured such that a photosensitive layer is formed on a drum-like metal frame body.

Further, the charging device 22 has, for example, a charging container. In the charging container, a discharging wire as a charging member is disposed, and the charging device 22 is not limited to this. For example, a roll-shaped charging member may be used.

Furthermore, a laser scanning device, an LED array, or the like is used as the exposure device 23.

Moreover, a developing device based on a single-component development system using the nonmagnetic toner is used as the developing device 24. In addition, details of the developing device 24 will be described later.

Further, any type of the transfer device 25 may be used when it applies the transfer electric field for electrostatically transferring the toner image on the photoconductor 21 to the recording material 28 side. For example, a roll-shaped transfer member to which the transfer voltage is applied is used, but the transfer device is not limited to this, and a transfer corotoron or the like using the discharging wire may be used.

Furthermore, a cleaning container, which is open toward the photoconductor 21 and contains the remaining toner, is provided as the cleaning device 26. A plate-like cleaning member 261 such as a blade or a scraper is disposed at the edge on the downstream side of the photoconductor 21 in the rotation direction in the opening of the cleaning container, and a brush-shaped or roll-shaped rotation cleaning member 262 is disposed on the upstream side of the plate-like cleaning member 261 in the rotation direction of the photoconductor 21. However the cleaning member is not limited to this, and any type may be used.

In addition, all or some of the photoconductor 21, the charging device 22, the developing device 24, and the cleaning device 26 may be assembled in advance as a process cartridge which is an image forming assembly, and may be detachably mounted on the housing section which is provided in advance in the image forming apparatus casing.

Basic Configuration of Developing Device

In the present example, as shown in FIGS. 2 to 5, the developing device 24 has a development container 40 that contains the nonmagnetic toner T and is open toward the photoconductor 21. A developing roller 41 is disposed at the portion of the development container 40 facing the opening, and a supplying roller 42 capable of supplying the nonmagnetic toner T within the development container 40 to the developing roller 41 is disposed on the rear surface of the developing roller 41. Further, a plate-like charging blade 45 is disposed on the downstream side of the portion of the developing roller 41, to which the toner is supplied by the supplying roller 42, in the toner transport direction. Furthermore, a toner replenishing mechanism 60, which is capable of replenishing the new nonmagnetic toner Tn to the supplying roller 42, is provided on the rear surface of the supplying roller 42.

In addition, one end of a sealing member (not shown in the drawing) formed of an elastic member is fixed on the lower edge of the opening of the development container 40, and the free end of the sealing member is disposed in elastic contact with the developing roller 41, thereby blocking the gap between the developing roller 41 and the development container 40.

Developing Roller and Supplying Roller

In the present example, the developing roller 41 rotates in the same direction as the photoconductor 21 at the portion opposed to the photoconductor 21, a roller main layer 41*b*, which has a predetermined volume resistivity and is made of resin or rubber, is formed around the metal shaft member 41*a*, and the surface of the roller main layer 41*b* has roughness so as to be able to transport the toner.

Further, the supplying roller 42 rotates in the direction opposite to the developing roller 41 at the portion opposed to the developing roller 41, and an elastic layer 42*b*, which has a predetermined volume resistivity and is elastically deformable, is formed around the metal shaft member 42*a*. The elastic layer 42*b* is constituted by foam such as urethane foam sponge rubber, and the surface is formed as a rough surface 42*c* (refer to FIG. 5) on which the toner may be sufficiently captured.

In the present example, the elastic layer 42*b* of the supplying roller 42 is more sufficiently softened than the roller main layer 41*b* of the developing roller 41. Hence, the developing roller 41 and the supplying roller 42 are disposed such that the developing roller 41 digs into the elastic layer 42*b* of the supplying roller 42 by a predetermined amount of digging. With such arrangement, the contact region N (nip region) is formed between both of them. In the present example, in the contact region N between the developing roller 41 and the supplying roller 42, the supplying roller 42 rotates in the direction from the top toward the bottom, and the developing roller 41 rotates in the direction from the top toward the bottom.

Hence, the supplying roller 42 separates the transporting toner on the developing roller 41 from the contact region N between itself and the developing roller 41, and supplies the toner on the supplying roller 42 side to the developing roller 41. In addition, the developing roller 41 holds the nonmagnetic toner T which is supplied from the supplying roller 42, and transports the toner to the development region M opposed to the photoconductor 21, whereby the toner is provided for development in the development region M.

Charging Blade

The charging blade 45 is constituted by a plate made of metal such as bronze, one end thereof is fixed at the edge of the opening of the development container 40, and the blade extends to protrude in a direction opposite to the rotation direction of the developing roller 41, and is disposed to be pressed in contact with the surface of the developing roller 41 at a predetermined pressure. Therefore, the toner T, which is held on the developing roller 41, passes the pressurized contact portion between the charging blade 45 and the developing roller 41. Thereby, the toner is triboelectrically charged, and is regulated by a predetermined amount of transport which may be determined in advance. In addition, the charging blade 45 is fixed at the edge of the opening of the development container 40 with a bracket 46 interposed therebetween.

Development Container

The development container 40 has a developing chamber 51 in which the developing roller 41 and the supplying roller 42 are disposed, and has a containing chamber 52 that contains the new toner Tn which may be replenished in the developing chamber 51, at the portion adjacent to the developing chamber 51.

In the present example, a block-like partitioning member 53, which partitions the developing chamber 51 and the containing chamber 52, is provided in the development container 40 so as to be apart from the bottom wall of the development container 40. Further, the bottom wall of the development container 40 is integrally formed with double-barreled curved portions 40*a* and 40*b* which are curved to protrude downward, and a chevron-shaped division portion 54 is formed at the portion of the boundary between the curved portions 40*a* and 40*b*.

Toner Replenishing Mechanism

In the present example, in the toner replenishing mechanism 60, the new toner Tn is contained in the containing chamber 52 of the development container 40, the containing chamber 52 and the developing chamber 51 are connected through a toner transporting path 61, and an agitator 62 as a stirring transporting member, by which the new toner Tn is transported toward the developing chamber 51 through the toner transporting path 61 while being stirred, is disposed in the containing chamber 52.

In addition, the curved portion 40*b* corresponding to the containing chamber 52 in the bottom wall of the development container 40 is formed to be curved along the curvature of the locus of the rotation free end of the agitator 62.

Toner Transporting Path

In the present example, the toner transporting path 61 is formed between the partitioning member 53 and the curved portion 40*b* as a part of the bottom wall of the development container 40.

Figure 5:
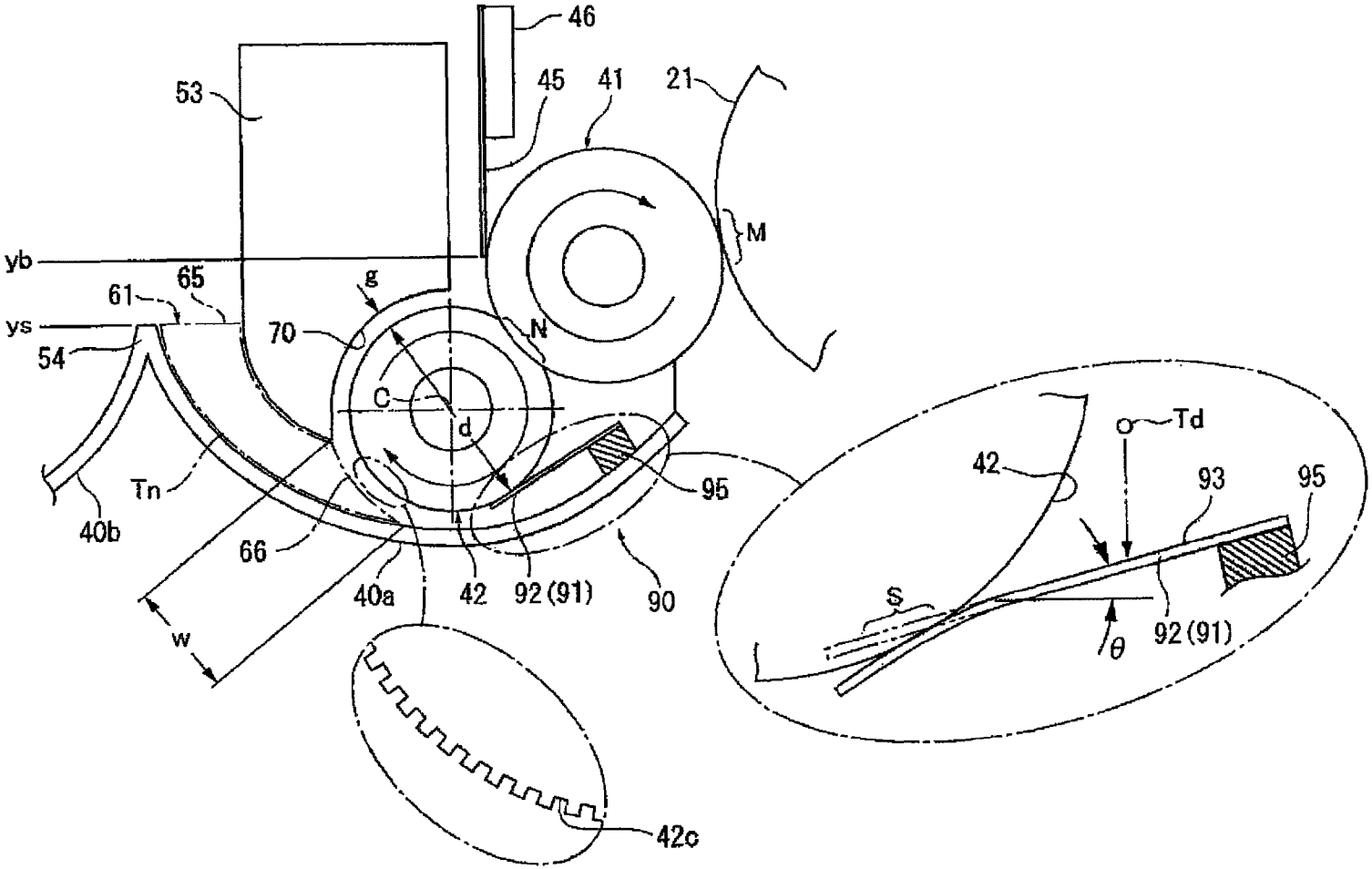
FIG. 5 is an explanatory diagram illustrating a detail of the principal part of the developing device shown in FIG. 4.

Here, in the toner transporting path 61, as shown in FIG. 5, a containing chamber side opening 65 is positioned above a developing chamber side opening 66, and is formed in a shape which is curved along the curved portion 40*a* from the containing chamber 52 toward the developing chamber 51.

Further, the developing chamber side opening 66 of the toner transporting path 61 is disposed to face the supplying roller 42, whereby the replenishment region X for replenishing the new toner Tn to the developing chamber 51 is formed.

In particular, in the present example, the developing chamber side opening 66 of the toner transporting path 61 is formed at the portion (in the present example, the portion separated by a half of the circumference) apart from the contact region N between the developing roller 41 and the supplying roller 42, and is provided below the center position C of the supplying roller 42, and the width w of the developing chamber side opening 66 along the rotation direction of the supplying roller 42 is set to be smaller than the outer diameter d of the supplying roller 42 on the projection plane viewed from the supplying roller 42.

In addition, in the present example, the new toner Tn within the containing chamber 52 is transported to the toner transporting path 61 by the agitator 62. Thus, as indicated by the chain line of FIG. 5, the toner transporting path 61 is filled with the new toner Tn remaining by its own weight, and the toner presses the supplying roller 42 through the developing chamber side opening 66.

Division Portion and Partitioning Member

Further, the containing chamber side opening 65 of the toner transporting path 61 is provided at the position ys corresponding to the apex of the chevron-shaped division portion 54 which is integrally formed on a part of the bottom wall of the development container 40. However, it is preferable that the opening be set at least below the contact position yb with the developing roller 41 in the charging blade 45. When setting is made on the basis of the dimensions mentioned above, even when the new toner Tn remains and is filled in the toner transporting path 61, there is no concern that the toner within the developing chamber 51 is pushed up to the contact position yb with the developing roller 41 in the charging blade 45 by application of the pressure caused by the toner remaining portion of the new toner Tn, and it is possible to effectively prevent the pressure contact state of the charging blade 45 to the developing roller 41 from being changed in accordance with an increase in the toner filled at the position of the charging blade 45 of the developing chamber 51.

Furthermore, in the present example, a regulating surface 70, which is opposed to the supplying roller 42 and has a curved shape along the circumferential surface of the supplying member 42 with a gap g interposed therebetween, is formed at the portion of the partitioning member 53 adjacent to the developing chamber side opening 66 of the toner transporting path 61. Here, any value of the gap g may be set when the toner layer to be captured on the supplying roller 42 may be regulated by the gap, but may be set to satisfy the maximum amount of consumed toner per unit time in the developing device 24. In the present example, the gap is set in a range of 0.5 mm to 1.0 mm. In this case, the lower limit (0.5 mm) is set to a dimension which is necessary to keep the partitioning member 53 being not in contact with the supplying roller 42 in view of the adhesion tolerance when the partitioning member 53 is mounted in the development container 40. In addition, the upper limit (1.0 ram) is set to a dimension which is necessary to regulate the toner layer to be captured on the supplying roller 42.

Power Supply for Generating Electric Field

In the present example, a developing power source 81, which is for generating an electric field for development between the developing roller 41 and the photoconductor 21, is provided in the developing roller 41. Further, a supplying power source 82, which is for generating an electric field for supplying the nonmagnetic toner T to the developing roller 41, is provided in the supplying roller 42.

Here, the developing power source 81 is configured to apply a developing voltage, in which the AC component is superposed upon the predetermined DC component, to the developing roller 41. Further, the supplying power source 82 has the DC component of the predetermined electric potential difference (also including '0') relative to the DC component of the developing power source 81, and may be configured to apply a supplying voltage in which the AC component having the same cycle as the AC component of the developing power source 81 are superposed upon the DC component.

However, even though the electric field for supply is not applied between the developing roller 41 and the supplying roller 42, when the supplying capability of the toner in the contact region N between both of them is secured, by employing a system that uses the developing power source 81 as the supplying power source 82, the electric potential difference between both of them may be set to approximately 0.

Adhesion Mechanism

In particular, in the present exemplary embodiment, an adhesion mechanism 90 is provided below the contact region N between the developing roller 41 and the supplying roller 42 in the developing chamber 51 in the development container 40, and is configured to adhere the toner, which is separated from the developing roller 41 and the supplying roller 42, onto the supplying roller 42.

As shown in FIG. 5, the adhesion mechanism 90 according to the present example has a guiding member 91 that receives the separated toner Td, which is separated when passing through the contact region N, and guides the separated toner Td, which is received, toward the supplying roller 42. The mechanism moves the separated toner Td, which is received in the guiding member 91, toward the supplying roller 42 by pressing a part of the guiding member 91 in contact with the circumferential surface of the supplying roller 42, and adheres the toner onto the circumferential surface of the supplying roller 42.

In the present example, the guiding member 91 is formed of an elastic sheet 92 which is elastically deformable, one end of the elastic sheet 92 is fixed onto an adhering target member 95 which is provided on a part of the bottom wall of the development container 40, and the elastic sheet 92 is inclined at an angle θ to the lateral direction such that the pressure contact portion S between itself and the supplying roller 42 is positioned below the receiving portion for the separated toner Td in the elastic sheet 92.

Examples of such a type of the elastic sheet 92 include a thermoplastic polyurethane sheet, a polyimide sheet, a polyester sheet, a PET sheet, and the like. Further, regarding the inclination angle θ of the elastic sheet 92, the lower limit is set to a value (for example 10°) which is necessary to roll the separated toner Td. In contrast, when the inclination angle θ is excessively large, it is conceivable that the volume of the portion receiving the separated toner Td is reduced. Therefore, the upper limit is set to a range (for example 45°) which does not cause separation defects from the supplying roller 42 due to an increase in pressure of the toner at the receiving portion.

In particular, in the present example, it is preferable that the surface of the elastic sheet 92 (corresponding to the surface of the side on which the separated toner Td is received) have a smoothed surface 93 by which the separated toner Td may be rolled toward the supplying roller 42. It suffices that the smoothed surface 93 described herein satisfies for example a relationship of arithmetic mean roughness Rz represented by $Rz \leq 0.6$ μm.

Further, in the present example, the pressure contact portion S of the elastic sheet 92 is the vicinity of the leading end of the elastic sheet 92, and the contact force of the elastic sheet 92 applied to the supplying roller 42 is set to be smaller than the contact force in the contact region N between the developing roller 41 and the supplying roller 42. Specifically, regarding the straightened state in which the elastic sheet 92 is not elastically deformed, when the amount of elastic deformation at the pressure contact with the supplying roller 42 is defined by an amount of digging, the contact force is calculated on the basis of the elastic coefficient of the elastic sheet 92 and the amount of digging. Thereby, the contact force of the elastic sheet 92 may be appropriately set.

Furthermore, in the present example, the pressure contact portion S of the elastic sheet 92 is displaced from the lowermost portion of the supplying roller 42 toward the contact region N. For this reason, at the pressure contact portion S of the elastic sheet 92, the contact force is gradually increased toward the leading end side of the elastic sheet 92.

Basic Operation of Developing Device

Figure 3:
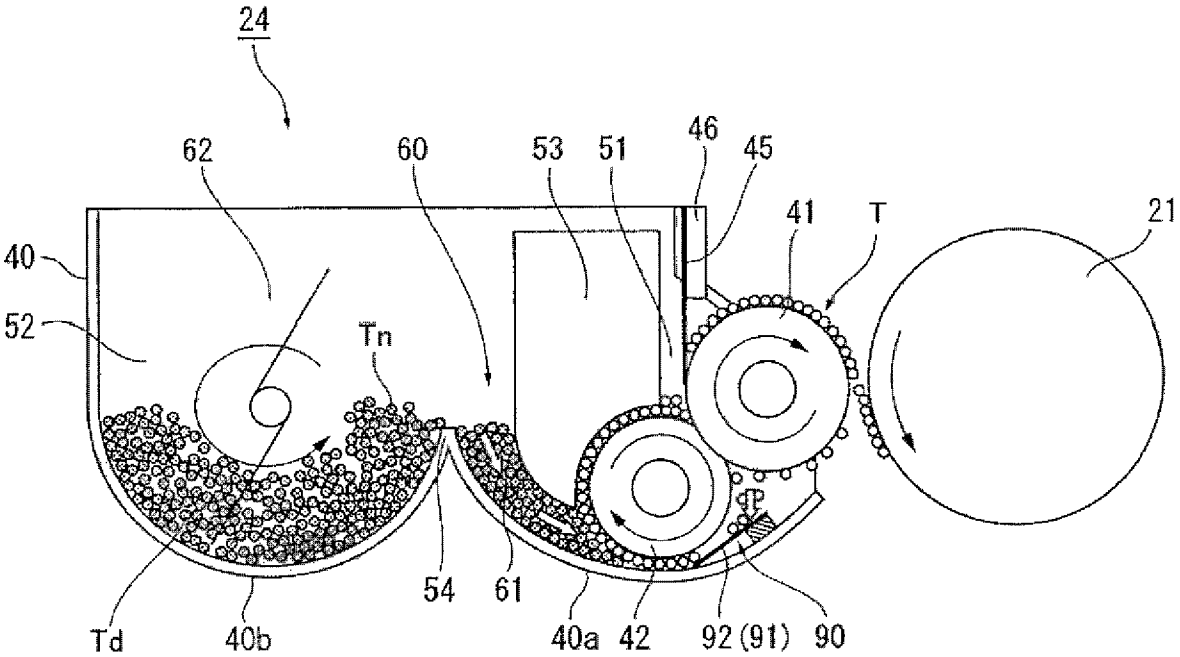
FIG. 3 is an explanatory diagram illustrating a developing device used in Exemplary Embodiment 1.
Figure 4:
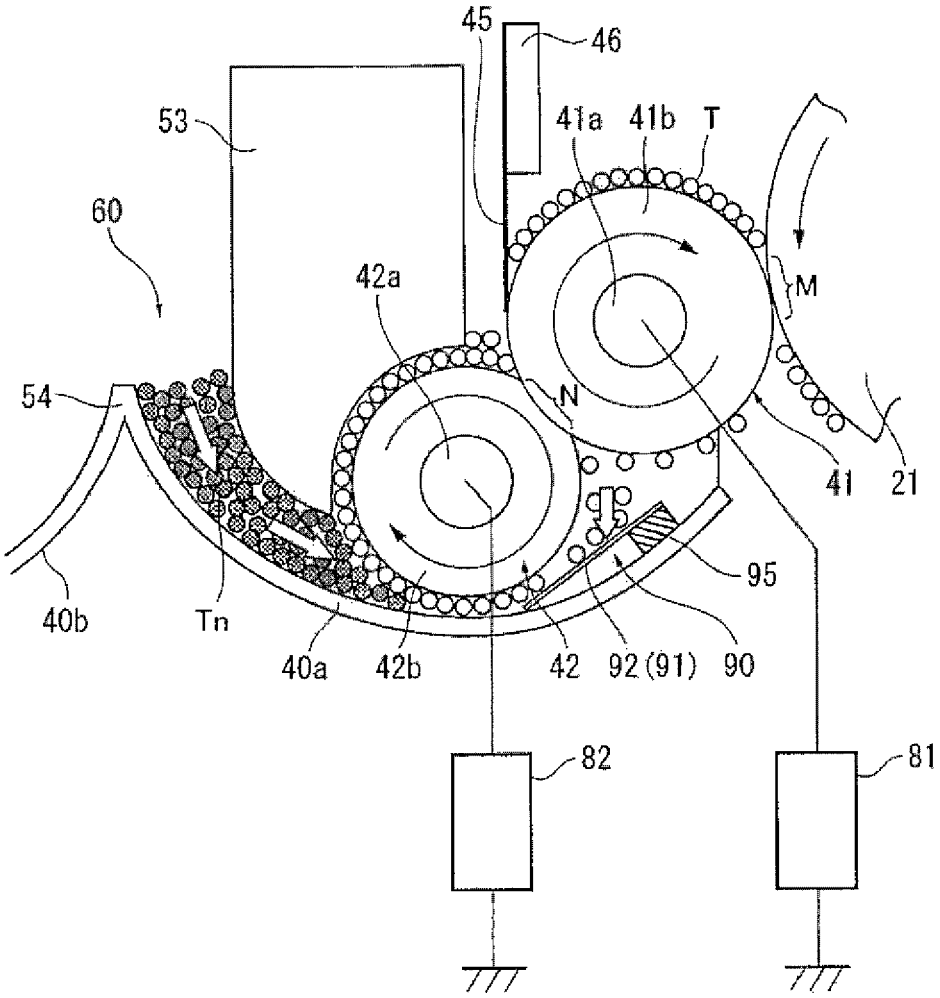
FIG. 4 is an explanatory diagram illustrating a principal part of the developing device shown in FIG. 3.

In the developing device 24 according to the present exemplary embodiment, as shown in FIG. 3, the supplying roller 42 rotates with the toner T captured, and transports the toner up to the contact region N between itself and the developing roller 41.

In the present example, the developing roller 41 and the supplying roller 42 move in directions opposite to each other in the contact region N. Hence, when the toner T captured on the supplying roller 42 passes through the contact region N, a part of the toner T is supplied to the developing roller 41, and the remaining part thereof is captured and remains on the supplying roller 42 or is separated and falls downward.

At this time, the toner T supplied to the developing roller 41 passes the charging blade 45 in accordance with rotation of the developing roller 41, is triboelectrically charged and regulated to the predetermined amount when passing the charging blade 45, is thereafter transported to the development region M between the developing roller 41 and the photoconductor 21. Thereby, the toner T is provided for development of the electrostatic latent image which is formed on the photoconductor 21.

Figure 6A:
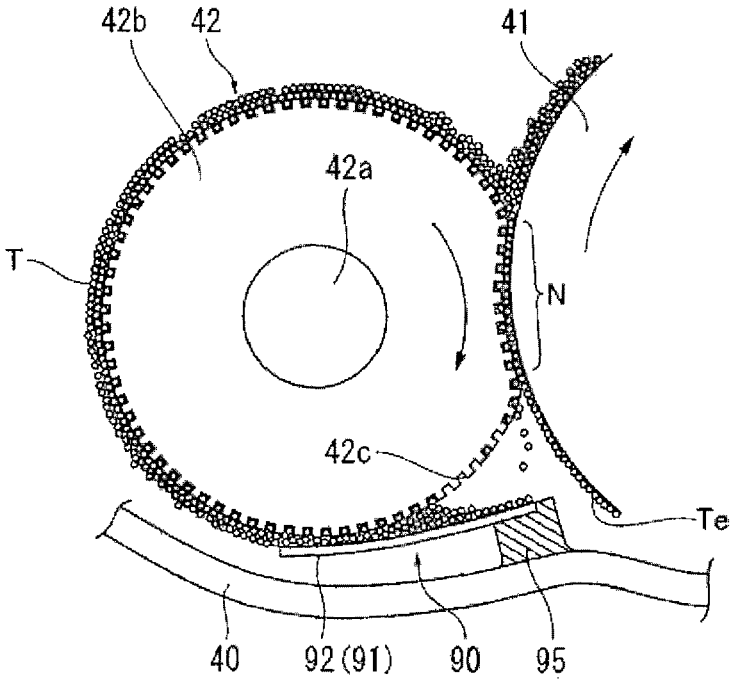
FIG. 6A is an explanatory diagram illustrating a behavior of the toner around a region of contact between a supplying roller and a developing roller.

Then, the unused remaining toner Te, which passes through the development region M of the developing roller 41, is transported up to the contact region N between the developing roller 41 and the supplying roller 42 by rotation of the developing roller 41, and most of the unused remaining toner Te is scraped off and separated in the contact region N (refer to FIG. 6A).

Further, the separated toner Td (refer to FIG. 6B), which is separated from the contact region N between the developing roller 41 and the supplying roller 42, is adhered onto the supplying roller 42 through the adhesion mechanism 90, and is transported again by rotation of the supplying roller 42 in a state where the separated toner Td is captured on the supplying roller 42 together with the remaining toner Ta (refer to FIG. 6B) which remains thereon.

Furthermore, when the toner captured on the circumferential surface of the supplying roller 42 is insufficient, the toner replenishing mechanism 60 appropriately replenishes the new toner Tn (refer to FIG. 7) on the circumferential surface of the supplying roller 42.

In such a manner, a series of the development operations is performed by the developing device 24.

Behavior of Toner Due to Adhesion Mechanism

In such a process of the development operations of the developing device 24, the behavior of the toner due to the adhesion mechanism 90 is as follows.

As shown in FIG. 6A, in the contact region N between the developing roller 41 and the supplying roller 42, the supplying roller 42 has the elastic layer 42*b* made of for example foam. Hence, the supplying roller 42 is recessed in the form along the surface of the developing roller 41, and is recovered to its original state, in which the roller is not elastically deformed, after passing the contact region N. Hence, the linear speed of the circumferential surface of the supplying roller 42 increases in accordance with the recovery deformation after passage of the contact region N, the repelling force is caused by the recovery of the elastic layer 42*b*, and a part of the toner T captured on the rough surface 42*c* of the circumferential surface of the supplying roller 42 is separated by the repelling force.

In contrast, the unused remaining toner Te, which is not provided for development in the development region M of the developing roller 41, is transported to the contact region N by rotation of the developing roller 41, but the unused remaining toner Te, which is held on the developing roller 41, is scraped off and separated at the portion of the contact region N which is positioned on the upstream side (corresponding to the downstream side in the rotation direction of the supplying roller 42) in the rotation direction of the developing roller 41.

Figure 6B:
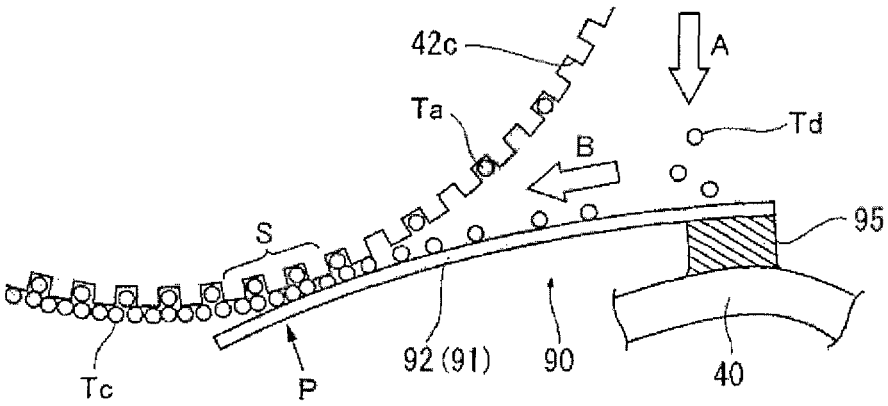
FIG. 6B is an explanatory diagram illustrating a behavior of the separated toner.

In such a manner, the separated toner Td, which is separated in the contact region N, falls downward as indicated by the arrow A of FIG. 6B, but is received and accumulated on the elastic sheet 92 as the guiding member 91 which is an element of the adhesion mechanism 90.

In this state, the elastic sheet 92 has a smoothed surface 93, and is inclined more obliquely downward at the pressure contact portion S coming into contact with the supplying roller 42 than the receiving portion for the separated toner Td. Thus, the separated toner Td, which is received on the elastic sheet 92, rolls along the inclined smoothed surface 93 of the elastic sheet 92, and moves toward the pressure contact portion S coming into contact with the supplying roller 42 as indicated by the arrow B of FIG. 6B.

In addition, the contact force P at the pressure contact portion S of the elastic sheet 92 gradually increases as it gets closer to the leading end of the elastic sheet 92 in accordance with the curvature of the circumferential surface of the supplying roller 42. Thus, the separated toner Td, which moves along the surface of the elastic sheet 92, is gradually pressed until reaching the pressure contact portion S of the elastic sheet 92, is triboelectrically charged between the elastic sheet 92 and the supplying roller 42, and is captured on the rough surface 42*c* of the circumferential surface of the supplying roller 42 together with the remaining toner Ta which remains thereon.

At this time, the contact force P of the elastic sheet 92 is distributed to be substantially equivalent throughout the pressure contact portion S along the axis direction of the supplying roller 42. Thus, the amount of transported toner on the circumferential surface of the supplying roller 42 is stably determined by the elastic sheet 92, and is averaged in the axis direction. Hence, at the supplying roller 42, in addition to the remaining toner Ta, the separated toner Td is tightly pressed with the contact force P by the elastic sheet 92, and is adhered and attached onto the circumferential surface of the supplying roller 42 by the image force of the toner. As a result, when passing the pressure contact portion S of the elastic sheet 92, the old toner Tc, which includes the remaining toner Ta and the separated toner Td, is captured on the circumferential surface of the supplying roller 42, and is transported again by rotation of the supplying roller 42.

As described above, since the separated toner Td is mostly adhered onto the circumferential surface of the supplying roller 42, the separated toner Td is prevented from being accumulated in the developing chamber 51 which is positioned below the contact region N.

Behavior of Toner Due to Toner Replenishing Mechanism

Behavior of New Toner and Old Toner in Replenishment Region

Figure 7A:
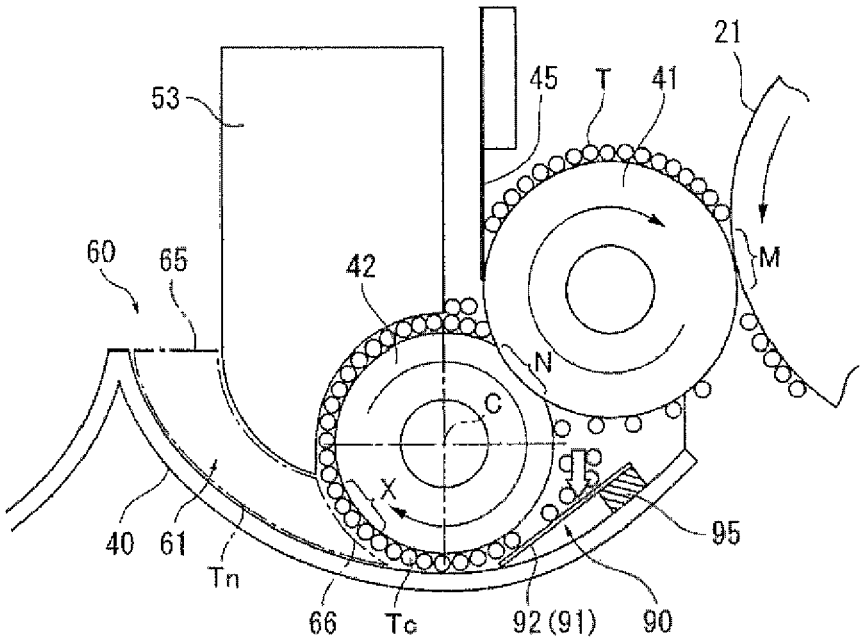
FIG. 7A is an explanatory diagram illustrating a behavior of the toner around a replenishment region of a new toner.

In such a manner, the supplying roller 42 does not transport the new toner Tn but transports the old toner Tc again to the replenishment region X of the toner replenishing mechanism 60 as shown in FIG. 7A.

In the present example, the toner replenishing mechanism 60 has a curved toner transporting path 61 which connects the containing chamber 52 and the developing chamber 51, the developing chamber side opening 66 of the toner transporting path 61 is disposed to face the supplying roller 42, and the developing chamber side opening 66 is disposed below the containing chamber side opening 65 of the toner transporting path 61.

Hence, a substantially constant amount of the new toner Tn remains and is filled in the toner transporting path 61, the pressure caused by the own weight of the toner remaining portion of the new toner Tn (the portion indicated by the chain line of FIG. 7A) is applied to the developing chamber side opening 66, the interface is formed between the new toner Tn and the toner within the developing chamber 51 by the toner remaining portion of the new toner Tn.

In addition, the new toner Tn, which is contained in the containing chamber 52, is transported toward the toner transporting path 61 by the agitator 62, but the new toner Tn remains and is filled in advance in the toner transporting path 61, and thus the fill amount of the new toner Tn, which remains in the toner transporting path 61, is scarcely changed.

Further, in the present example, the developing chamber side opening 66 of the toner transporting path 61 is formed below the center position C of the supplying roller 42, and the toner transporting path 61 is formed in a curved shape, and extends slightly obliquely downward in the lateral direction at the portion close to the developing chamber side opening 66.

In contrast, the layer of the old toner Tc, which is captured on the supplying roller 42, is formed around the supplying roller 42, and is moved to face the developing chamber side opening 66 of the toner transporting path 61 by rotation of the supplying roller 42.

Then, at the portion facing the developing chamber side opening 66, the supplying roller 42 rotates in a direction in which it approaches the toner transporting path 61 from the lower side toward the upper side. Hence, the direction of the pressing force of the new toner Tn from the developing chamber side opening 66 of the toner transporting path 61 is set to be opposite to the rotation direction of the supplying roller 42, and thus the old toner Tc, which is transported again by the supplying roller 42, is transported again in a state where the toner is smoothed and adhered by the adhesion mechanism 90. Therefore, in the developing chamber side opening 66, the old toner Tc on the supplying roller 42 moves in a state where the old and new toners are prevented from being mixed along the interface formed by the toner remaining portion of the new toner Tn in the toner transporting path 61.

On this point, in the present exemplary embodiment, when the developing chamber side opening 66 of the toner transporting path 61 is formed up to the region above the center position C of the supplying roller 42, in the upper region of the center position C of the supplying roller 42, the supplying roller 42 rotates in a direction in which it is separated from the toner transporting path 61. Hence, the new toner Tn positioned on the interface of the toner remaining portion of the new toner Tn tends to be drawn by rotation of the supplying roller 42, and thus there is a possibility that the new toner Tn tends to leak toward the supplying roller 42. For this reason, the present exemplary embodiment is preferable.

In addition, also when the rotation direction of the supplying roller 42 is the backward direction (the direction of rotation from the top to the bottom at the portion facing the developing chamber side opening 66), the new toner Tn positioned on the interface of the toner remaining portion of the new toner Tn is drawn by rotation of the supplying roller 42, and thus there is a concern that the new toner Tn tends to leak toward the supplying roller 42. For this reason, the present exemplary embodiment is preferable.

Capture State I of Old Toner Captured on Supplying Roller (Sufficiently Captured)

Figure 7B:
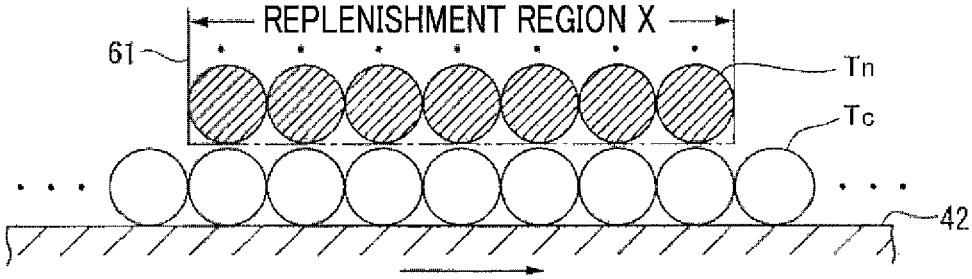
FIG. 7B is an explanatory diagram illustrating a behavior of the toner around the replenishment region of the new toner when a re-transported toner (old toner) is sufficiently captured on the supplying roller.

In such a state, as shown in FIG. 7B, when the old toner Tc which is the re-transported toner is sufficiently captured on the supplying roller 42, there is no extra toner capture space on the circumferential surface of the supplying roller 42. Thus, the new toner Tn, which remains in the toner transporting path 61, is unlikely to be captured on the circumferential surface of the supplying roller 42.

Further, the new toner Tn, which remains in the toner transporting path 61, presses the circumferential surface of the supplying roller 42. Therefore, the old toner Tc, which is captured on the supplying roller 42, may be prevented from flowing by the interface of the new toner Tn which remains in the toner transporting path 61. Thus, there is less concern that the old toner Tc leaks into and gets mixed with the new toner Tn within the toner transporting path 61.

Capture State II of Old Toner Captured on Supplying Roller (Insufficiently Captured)

Figure 7C:
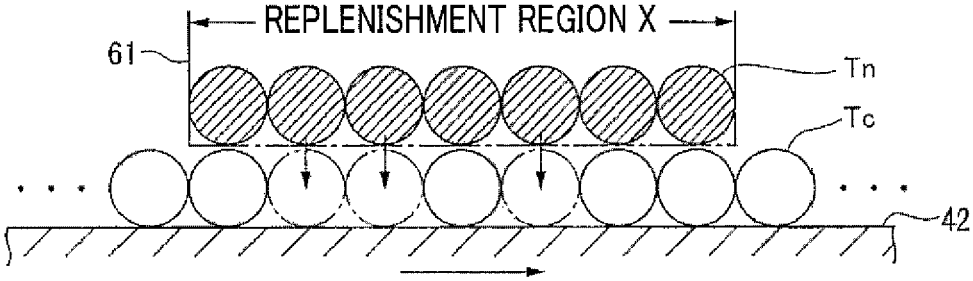
FIG. 7C is an explanatory diagram illustrating a behavior of the toner around the replenishment region of the new toner when the re-transported toner (old toner) is insufficiently captured on the supplying roller.

In contrast, as shown in FIG. 7C, when the old toner Tc as a re-transported toner captured on the supplying roller 42 is insufficient, the new toner Tn, which remains in the toner transporting path 61, presses the circumferential surface of the supplying roller 42 by its own weight. Hence, the new toner Tn is replenished at the location, at which the old toner Tc is not captured, on the supplying roller 42.

As described above, the new toner Tn is not replenished when the old toner Tc is sufficiently captured on the supplying roller 42, and the new toner Tn is replenished when the old toner Tc is insufficient. Thus, the old toner Tc and the new toner Tn are unnecessarily mixed on the circumferential surface of the supplying roller 42, and the old toner Tc is preferentially consumed.

Behavior of Toner Used with Passage of Time in Toner Transporting Path

In the present exemplary embodiment, the new toner Tn, which remains in the toner transporting path 61, is pressed slightly obliquely downward from the developing chamber side opening 66, while the old toner Tc (refer to FIG. 7), which is captured on the supplying roller 42, is moved by rotation from the bottom toward the top at the portion facing the developing chamber side opening 66. Thereby, it may be observed that the old and new toners come into contact.

Figure 8:
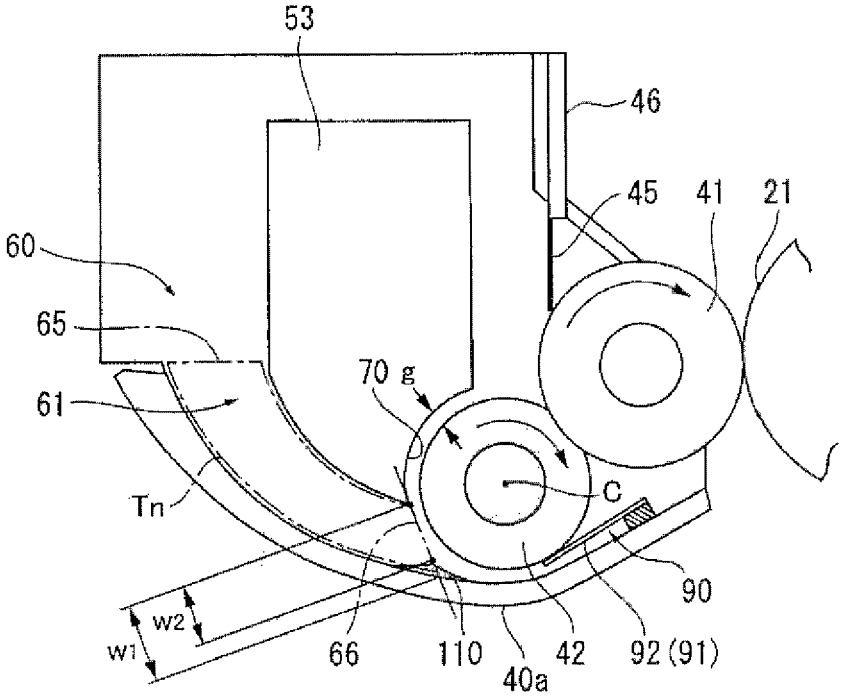
FIG. 8 is an explanatory diagram illustrating a behavior of the toner used in the toner transporting path with the passage of time.

When the phenomenon of the contact between the old and new toners repeatedly occurs as the toners are used with the passage of time, as shown in FIG. 8, in the vicinity of the lower edge of the developing chamber side opening 66 of the toner transporting path 61, there is a location in which the toner remaining portion of the new toner Tn and the old toner Tc captured on the supplying roller 42 are merged. In this case, the pressure is applied onto the circumferential surface of the supplying roller 42 by own weight of the toner remaining portion of the new toner Tn, while the toner remaining portion of the new toner Tn is tightly pressed by the rotational force of the old toner Tc which is captured on the supplying roller 42. Hence, both toners are gradually accumulated and solidified in a soft blocking shape at the location at which both of them are merged, thereby forming a substantially triangular accumulation wall 110 (so-called dead toner) by the toners.

As described above, when the accumulation wall 110 is formed by the toners in the vicinity of the lower edge of the developing chamber side opening 66 of the toner transporting path 61 as the toners are used with the passage of time, the old toner Tc, which is captured on the supplying roller 42, collides against the accumulation wall 110 immediately after the toner reaches the developing chamber side opening 66. Thus, the old toner Tc is further effectively prevented from reversely flowing toward the toner transporting path 61.

Further, when the accumulation wall 110 is formed by these toners, the width of the developing chamber side opening 66 is originally set to w1, and is practically changed to w2 (w2>w1) in accordance with the formation of the accumulation wall 110. Hence, it is preferable to perform design in consideration of the situation where the accumulation wall 110 is formed by the toners.

In addition, though the accumulation wall 110 is formed by the toners as the toners are used with the passage of time, it is apparent that a partitioning member corresponding to the accumulation wall 110 formed by the new toner Tn may be separately provided in the development container 40.

Regulation of Amount of Toner Captured on Supplying Roller

Further, in the present exemplary embodiment, there is a concern that the toner around the old toner Tc captured on the circumferential surface of the supplying roller 42 follows the old toner Tc due to viscosity or the like and is moved in accordance with the rotation of the supplying roller 42.

However, in the present exemplary embodiment, the regulating surface 70, which has a curved shape along the circumferential surface of the supplying member 42 with a predetermined gap g, is formed on the partitioning member 53 adjacent to the developing chamber side opening 66 of the toner transporting path 61. Thus, for example, even when the extra toner other than the toner captured around the supplying roller 42 follows and moves at the portion facing the bottom wall of the development container 40 or the developing chamber side opening 66 of the toner transporting path 61, when the extra toner passes the regulating surface 70 of the partitioning member 53, the extra amount of the toner captured on the circumferential surface of the supplying roller 42 is scraped off, and the amount of toner captured on the supplying roller 42 is regulated to a necessary amount.

Comparative Embodiment 1

Next, in order to evaluate the performance of the developing device according to Exemplary Embodiment 1, performance of an exemplary developing device according to Comparative Embodiment 1 will be described.

Figure 9:
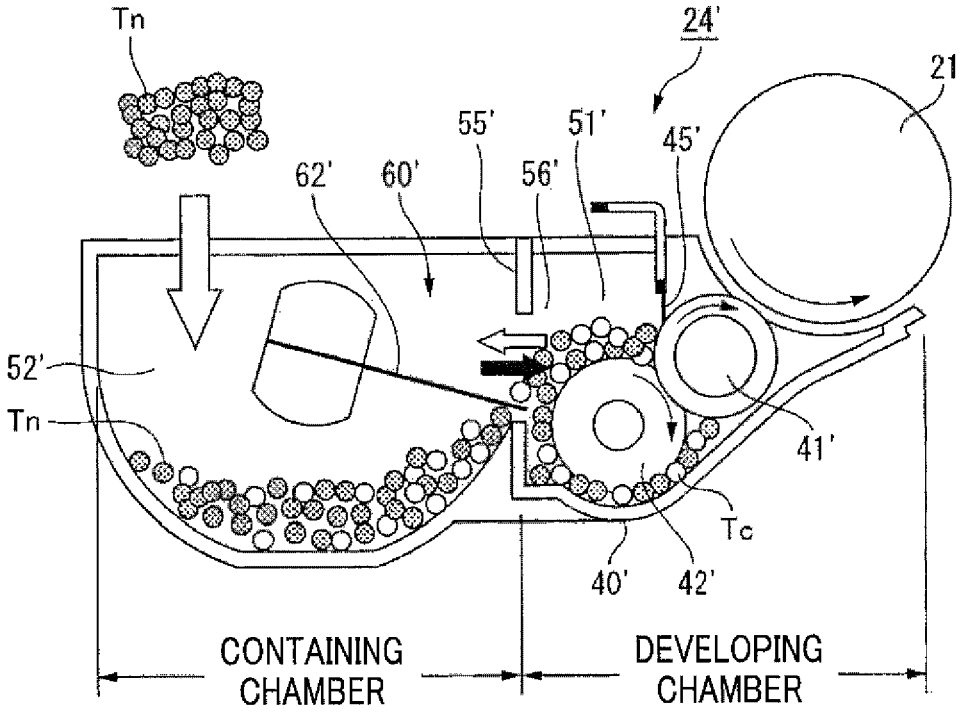
FIG. 9 is an explanatory diagram illustrating an example of a developing device according to Comparative Embodiment 1.

FIG. 9 shows the developing device according to Comparative Embodiment 1.

In the drawing, in a developing device 24', a division wall 55' is provided in a development container 40', a developing chamber 51' and a containing chamber 52' of the new toner Tn are divided, a toner transporting hole 56' is provided on a part of the division wall 55', a developing roller 41', a supplying roller 42', and a charging blade 45' are disposed in the developing chamber 51', and an agitator 62' as a toner replenishing mechanism 60' is disposed in the containing chamber 52'. In contrast, the developing device 24' does not employs 'the partitioning member 53 having the regulating surface 70', 'the new-toner-remaining-type toner transporting path 61', and 'the adhesion mechanism 90' which are employed in the developing device 24 according to Exemplary Embodiment 1.

In the present comparative embodiment, the following effects are provided.

That is, when the toner replenishing operation is started by the agitator 62', the new toner Tn within the containing chamber 52' is replenished from the toner transporting hole 56' into the developing chamber 51', the amount of toner within the developing chamber 51' increases, and exceeds the height of the toner transporting hole 56', and then the old toner Tc reversely flows from the developing chamber 51' into the containing chamber 52'.

Further, the separated toner, which is separated from the contact region N' between the developing roller 41' and the supplying roller 42', is gradually accumulated in the developing chamber 51', is not consumed, is subjected to frictional stress from the supplying roller 42', and is then mixed with the new toner Tn.

Furthermore, when the new toner Tn and the old toner Tc are mixed in the developing chamber 51', external additives of the old toner Tc are exfoliated or the external additives are embedded in the toner particle basis, and thus there is a big difference in the coating level compared with the new toner Tn. Hence, when both of them are mixed, both of them are mutually electrically charged by the charging blade 45', and thus there is a big difference in charging distribution between the new toner Tn and the old toner Tc. For this reason, some of the toner tends to be erroneously charged, and the phenomenon that the erroneously charged toner is unnecessarily scattered on the background of the recording material and the like tends to occur.

As described above, in the present comparative embodiment, it is difficult to prevent the old and new toners from being unnecessarily mixed on the supplying roller 42'. Conversely, in Exemplary Embodiment 1, by employing the new-toner-remaining-type toner replenishing mechanism 60 or the adhesion mechanism 90, it is possible to solve the problem of the developing device according to Comparative Embodiment 1.

Toner Ejection Control

In the present exemplary embodiment, the control device 100 performs the toner ejection control to forcedly eject the toner within the developing device 24 when the amount of consumed toner is smaller than a prescribed amount which is determined in advance.

In the configuration (refer to FIG. 3) of the developing device 24 of the present example, when the image output is small and the amount of consumed toner is excessively small, the toner on the supplying roller 42 or the unused remaining toner on the developing roller 41 repeatedly passes through the contact region N between the developing roller 41 and the supplying roller 42, a part of toner, which is separated, is adhered again onto the supplying roller 42 and transported again through the adhesion mechanism 90. Therefore, the old toner other than the new toner is likely to be circulated on the developing roller 41 and/or the supplying roller 42 in a state where the old toner is not consumed. In such a state, the extra stress is applied to the toner, and thus, for example, the external additives of the toner may be embedded in the toner, or the external additives may be separated from the toner. Hence, the charging characteristics of the toner are highly likely to be changed, or the fluidity of the toner is highly likely to be changed. When such a change in characteristics occurs in the toner, there is a concern that background fog occurs as the charge amount of the toner decreases, or image disarray (for example streaky image disarray) occurs due to fixing of the toner onto the charging blade 45 as the fluidity of the toner decreases.

Figure 10:
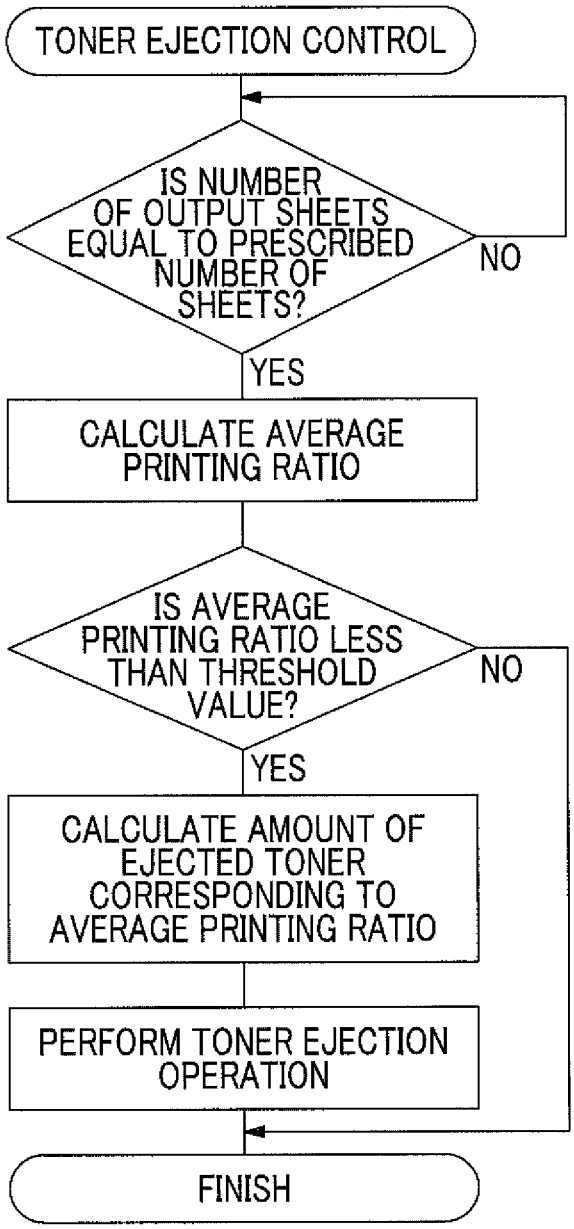
FIG. 10 is a flowchart illustrating a toner ejection control process employed in the present exemplary embodiment.

Accordingly, in the present exemplary embodiment, the toner ejection control shown in FIG. 10 is performed.

In order to perform the toner ejection control, as shown in FIG. 10, first, it is determined whether or not the number of output sheets reaches a prescribed number of sheets which is set to for example 500 in advance. The determination is continuously performed until the prescribed number of sheets is reached. When it is determined that the prescribed number of sheets is reached, from the image information hitherto obtained, the total number of dot counts (the sum of the total number of dots in image parts for each sheet) is subtracted by the output total area (the product between the number of output sheets and the total number of dots including image parts and non-image parts corresponding to the image forming area per one sheet), thereby calculating the average printing ratio per one output sheet.

Next, it is determined whether or not the calculated average printing ratio is less than a predetermined threshold value. At this time, when it is determined that the calculated average printing ratio is equal to or more than the threshold value, the toner is consumed by a certain degree, thus it is determined that there is a possibility of deterioration in the toner, and then the toner ejection control is terminated.

In contrast, when it is determined that the calculated average printing ratio is not equal to or more than the threshold value, that is, when it is determined that the average printing ratio is less than the threshold value, it is determined that deterioration in the toner is in progress, and thus the amount of ejected toner corresponding to the average printing ratio is calculated. At this time, as the method of calculating the amount of ejected toner, when the average printing ratio is small, the method of obtaining the amount of ejected toner, which is larger than that in a case where the average printing ratio is large, may be adopted. In addition, by finding the calculation expression in advance for calculating the relationship between the average printing ratio and the amount of ejected toner, the calculation may be made on the basis of the calculation expression. In addition, by dividing the average printing ratio into several groups in advance, the respective amounts of ejected toner corresponding to the respective groups may be determined in advance.

Then, when the amount of ejected toner is calculated, by controlling the charging device 22, the exposure device 23, the developing device 24, and the transfer device 25, an electrostatic latent image for ejection corresponding to the calculated amount of ejected toner is formed on the photoconductor 21, and the toner ejection operation may be performed in the form of developing the image through the developing device 24. Due to the toner ejection, not only the toner on the developing roller 41, but also the toner adhered onto the supplying roller 42 is consumed, and thus the old toner, which is likely to be deteriorated in the developing device 24, is removed.

Further, the toner, which is ejected onto the photoconductor 21, is cleaned by the cleaning device 26.

Such a toner ejection operation is performed at the timing different from the timing of outputting a normal image. For example, the operation may be appropriately performed in the range, in which the normal image formation is not performed, such as the image output interval or the time of starting or stopping the operation of the image forming apparatus. Further, at the time of performing such a toner ejection operation, in a case where the toner on the photoconductor 21 is cleaned in the cleaning device 26, the transfer device 25 is inactivated such that the toner on the photoconductor 21 is not transferred to the transfer device 25 side. Alternatively, in a case where the transfer device 25 is a contact type, the transfer device 25 may be separated from the photoconductor 21, or the electric field in the direction, in which the toner is not adhered onto the transfer device 25 side, is applied between the transfer device 25 and the photoconductor 21. Furthermore, in the present example, the toner, which is ejected onto the photoconductor 21 by such a toner ejection operation, is removed by the cleaning device 26, but instead of this, for example, the toner may be transferred onto the recording material 28 or may be removed by providing a different cleaning device.

The present exemplary embodiment describes a configuration in which the degree of deterioration in the toner is determined by calculating the average printing ratio per one sheet from the amount of toner accumulatively consumed until the predetermined number of output sheets is reached, but the determination on the degree of deterioration in the toner is not limited to this, and may be made as follows.

For example, from the amount of toner consumed until the activation time of the developing device 24 reaches the predetermined time, the amount of toner per unit time is calculated, and the degree of deterioration in the toner may be determined on the basis of whether or not the amount of toner per unit time is equal to or greater than the predetermined threshold value. In this case, when the amount of toner per unit time is small, the toner ejection operation may be performed.

Further, on the basis of how many outputs with the amounts of consumed toner per one sheet less than the predetermined threshold value are continuous, the degree of deterioration in the toner may be determined. Normally, in the image output in which the photo image output and the character image output are mixed, the average printing ratio is increased by the effect of the photo image output. Hence, for example, in most of the outputs, when the character image and the photo image are slightly mixed, it is conceivable that the outputs with small printing ratios may be continuous. Consequently, by detecting the state in which the outputs with small amounts of consumed toner are continuous in the number of output sheets, it is determined that there is a possibility of deterioration in the toner when the outputs are excessively continuous. In such a manner, the toner ejection may be performed.

Furthermore, an environmental condition may be added to the degree of deterioration in the toner.

—Modified Configuration of Adhesion Mechanism—

The present exemplary embodiment employs the following configuration: in the adhesion mechanism 90, by using the elastic sheet 92 as the guiding member 91, one end side of the elastic sheet 92 is fixed, and the other end side is pressed in contact with the circumferential surface of the supplying roller 42. However, the exemplary embodiment is not limited to this, and may be appropriately modified in design like Modified Configurations 1-1 to 1-3 shown in FIGS. 11A to 11C.

Modified Configuration 1-1

Figure 11A:
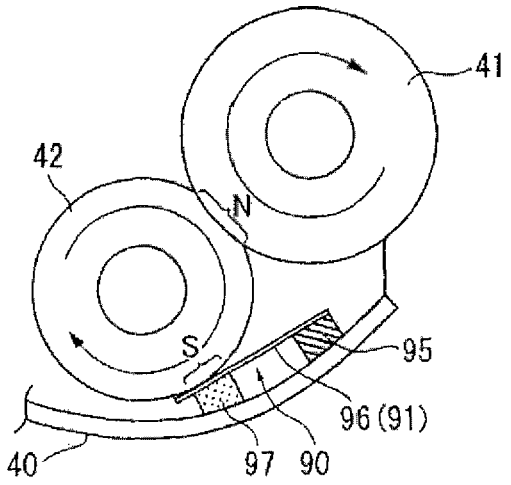
FIGS. 11A to 11C are explanatory diagrams illustrating modified configurations of an adhesion mechanism used in the present exemplary embodiment.

In the adhesion mechanism 90 shown in FIG. 11A, one end of a sheet member 96 is fixed onto the adhering target member 95 by using the sheet member 96 which is bendable as the guiding member 91, and the free end side is pressed in contact with the supplying roller 42. Further, an urging member 97, which urges the sheet member 96 in a direction of tightly pressing it toward the supplying roller 42 side, is provided between the portion of the sheet member 96, which corresponds to the pressure contact portion coming into contact with the supplying roller 42, and the inner wall of the development container 40. Here, an elastic member, a plate spring, or the like may be used as the urging member 97.

By using such an urging member 97, a condition of pressure contact of the sheet member 96 to the supplying roller 42 is kept substantially constant. Thereby, the separated toner, which reaches the pressure contact portion S of the sheet member 96, is adhered onto the supplying roller 42 by the effect of the more stabilized contact force.

In addition, in Modified Configurations 1, the sheet member 96 may be the elastic sheet 92 used in Exemplary Embodiment 1. However, it is not indispensable for the sheet member 96 itself to be disposed in pressure contact with the supplying roller 42 contrary to the elastic sheet 92. Any type of the plate spring made of metal (for example, SUS) or the like may be used when it has at least the surface nature by which the separated toner may be rolled and is bendable by being tightly pressed through the urging member 97.

Modified Configuration 1-2

Figure 11B:
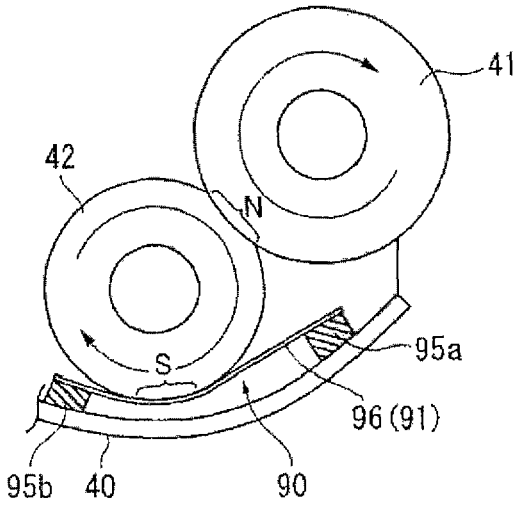

Further, in the adhesion mechanism 90 of FIG. 11B, the sheet member 96 is opposed to the supplying roller 42 so as to extend from the lower region of the contact region N between the supplying roller 42 and the developing roller 41 up to the opposed side region with the lowermost portion of the supplying roller interposed therebetween by using the bendable sheet member 96 as the guiding member 91, both end portions of the sheet member 96 are respectively fixed onto the adhering target members 95 (95*a*, 95*b*) provided in the development container 40, so that the middle portion of the sheet member 96 is pressed in contact with the vicinity of the lowermost of the supplying roller 42. Here, examples of the method of adjusting the contact force of the sheet member 96 include a method of adjusting a state of tension of the sheet member 96 to the adhering target member 95 by using a material, which is elastically deformable in a direction vertical to its surface, as the sheet member 96.

In the present configuration, the sheet member 96 is provided to stride over the lowermost portion of the supplying roller 42, and thus the pressure contact portion S of the sheet member 96 coming into contact with the supplying roller 42 is secured to be wide. Further, in the present configuration, it is necessary for the upstream side portion of the sheet member 96 in the rotation direction at the lowermost portion of the supplying roller 42 to be inclined obliquely downward from the receiving portion for the separated toner, which corresponds to the lower side of the contact region N between the developing roller 41 and the supplying roller 42, toward the lowermost portion of the supplying roller 42. Thereby, the separated toner, which is received on the sheet member 96, is sufficiently pressed and adhered at the pressure contact portion S between the sheet member 96 and the supplying roller 42.

Modified Configuration 1-3

Figure 11C:
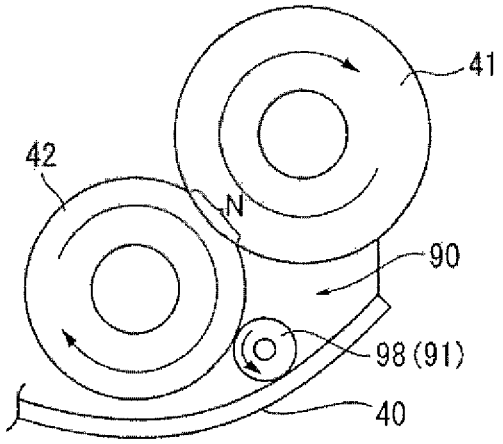

In the adhesion mechanism 90 shown in FIG. 11C, a rotational roller 98, of which the surface is smoothed, as the guiding member 91 is used, and the rotational roller 98 is disposed to be pressed in contact with the circumferential surface of the supplying roller 42 on the lower side of the contact region N between the developing roller 41 and the supplying roller 42, so that the rotational roller 98 is driven to be rotated by following the rotation of the supplying roller 42.

In the present example, the region, which is positioned to be closer to the supplying roller 42 than the uppermost portion of the rotational roller 98, on the circumferential surface of the rotational roller 98 is disposed at a position where the separated toner separated from the contact region N between the developing roller 41 and the supplying roller 42 may be received.

In the present example, the rotational roller 98 rotates in accordance with the rotation of the supplying roller 42. Thus, the separated toner, which is separated from the contact region N, falls down on the circumferential surface of the rotational roller 98, is then guided into the pressure contact portion S between the rotational roller 98 and the supplying roller 42, and is adhered onto the supplying roller 42.

Exemplary Embodiment 2

Figure 12A:
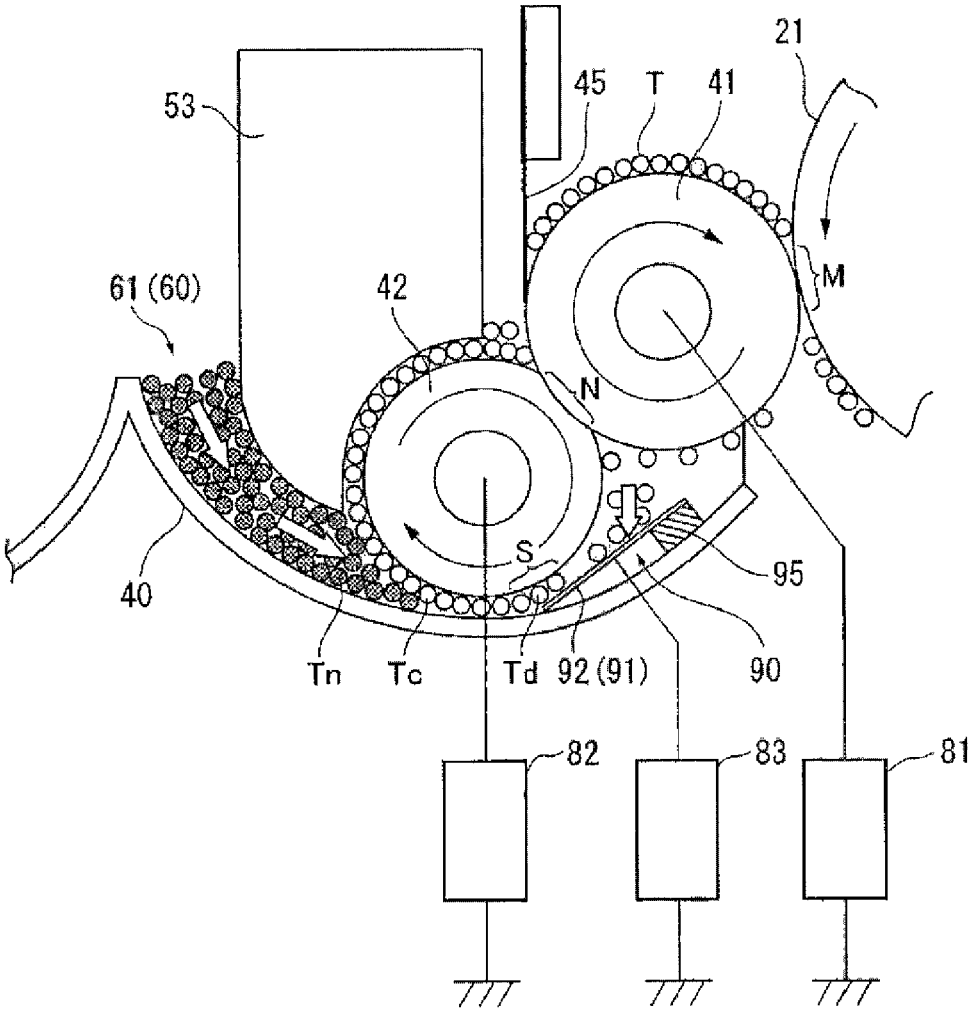
FIG. 12A is an explanatory diagram illustrating a principal part of a developing device according to Exemplary Embodiment 2.

FIG. 12A shows a principal part of a developing device according to Exemplary Embodiment 2.

In the drawing, the basic configuration of the developing device 24 is substantially the same as that of Exemplary Embodiment 1, but the developing device 24 has an adhesion mechanism 90 different from that of Exemplary Embodiment 1. It should be noted that the components the same as those of Exemplary Embodiment 1 are represented by the same reference numerals and signs, and the detailed description is omitted herein.

In the adhesion mechanism 90 of the present example, in a substantially similar manner to Exemplary Embodiment 1, the elastic sheet 92 having a cantilever supporting structure is used as the guiding member 91. However, in addition, in order to apply an attracting electric field which gives the conductivity to the elastic sheet 92 and is capable of attracting the toner T interposed between the elastic sheet 92 and the supplying roller 42 to the supplying roller 42 side, an attracting power source 83, which is capable of applying an attraction voltage for generating the attracting electric field, is connected to the elastic sheet 92.

In the present example, for example, a sheet, of which the volume resistivity determined in advance by distributing conductive filler is adjusted, may be used as the elastic sheet 92. Further, the attracting electric field may be appropriately set in terms of further prompting the adsorptive property of the toner in a range in which an undesired discharge does not occur between the supplying roller 42 and the elastic sheet 92 in consideration of the balance between the field and the supplying voltage applied to the supplying roller 42.

Figure 12B:
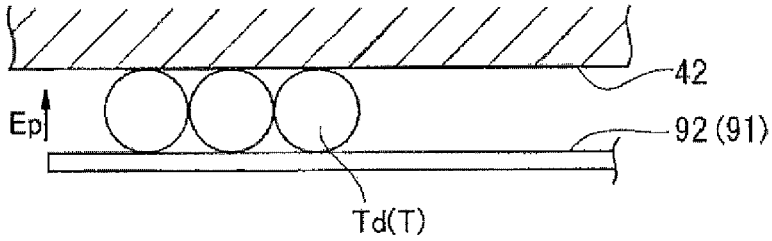
FIG. 12B is an explanatory diagram illustrating the action thereof.

In the present exemplary embodiment, as shown in FIGS. 12A and 12B, the attracting power source 83 applies an attracting electric field Ep (an electric field by which the polarity direction of the elastic sheet 92 side is the charge polarity of the toner) of the direction, in which the toner is attracted toward the supplying roller 42, between the supplying roller 42 and the elastic sheet 92. Hence, the separated toner Td (T), which reaches the pressure contact portion S of the elastic sheet 92, is subjected to the force in the direction in which the toner is attracted by the electric field applied to the supplying roller 42 side, and is further strongly rubbed between both of them. Thereby, the separated toner Td on the elastic sheet 92 is further strongly electrically charged, and is highly likely to be adhered onto the supplying roller 42. As a result, the separated toner Td is stably held on the supplying roller 42, and is transported toward the replenishment region X (corresponding to the developing chamber side opening 66 of the toner transporting path 61) of the toner replenishing mechanism 60 by the rotation of the supplying roller 42.

In addition, the present exemplary embodiment describes a configuration in which the entire elastic sheet 92 is formed to be electrically conductive. However, the exemplary embodiment is not limited to this, and the elastic sheet 92 may have the following laminated structure: the side of the elastic sheet 92 facing the supplying roller 42 is formed as a high resistance layer with a volume resistivity of for example $10^9$ Ωcm or more, and the opposite side thereof is formed as a conductive layer. In this case, the magnitude of the attracting voltage of the attracting power source 83 may be set to be larger than that in the case where the entire elastic sheet 92 is formed to be electrically conductive, as there is provided the high resistance layer. Further, due to the attracting power source 83, the high resistance layer tends to be electrically polarized, and thus it may also be expected that the elastic sheet 92 is more likely to be attracted toward the supplying roller 42. Furthermore, the present exemplary embodiment describes the adhesion mechanism 90 that employs the cantilever-supporting-type elastic sheet 92 as the guiding member 91. However, the exemplary embodiment is not limited to this, and it is needless to say that the configurations such as Modified Configurations 1-1 to 1-3 mentioned above may be adopted.

Exemplary Embodiment 3

Figure 13A:
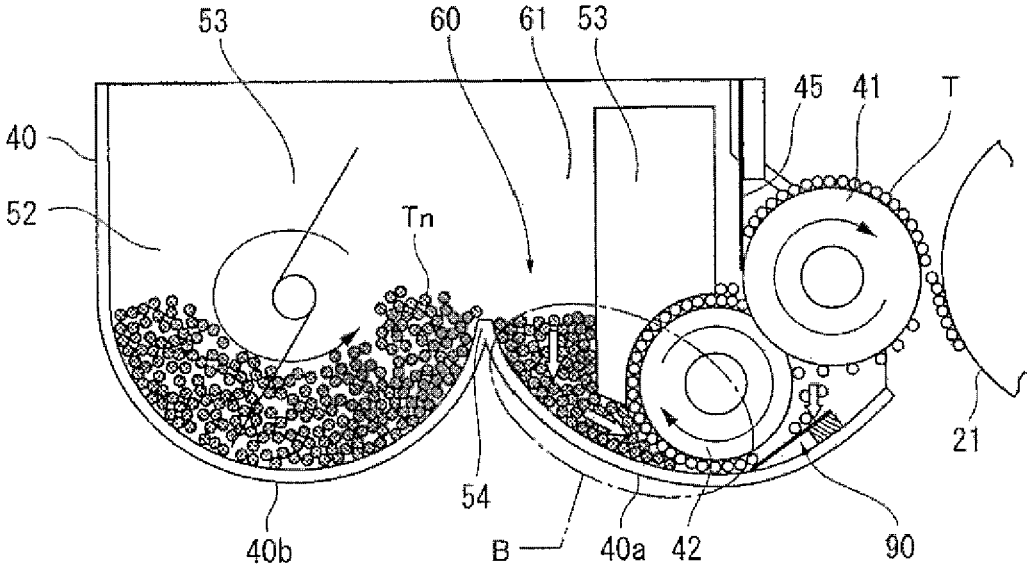
FIG. 13A is an explanatory diagram illustrating a principal part of a developing device according to Exemplary Embodiment 3.

FIG. 13A shows a principal part of a developing device according to Exemplary Embodiment 3.

In the drawing, the basic configuration of the developing device 24 is substantially the same as that of Exemplary Embodiment 1, but is different from that of Exemplary Embodiment 1 in the structure of the toner transporting path 61 in the toner replenishing mechanism 60. It should be noted that the components the same as those of Exemplary Embodiment 1 are represented by reference numerals and signs the same as those of Exemplary Embodiment 1, and the detailed description is omitted herein.

Figure 13B:
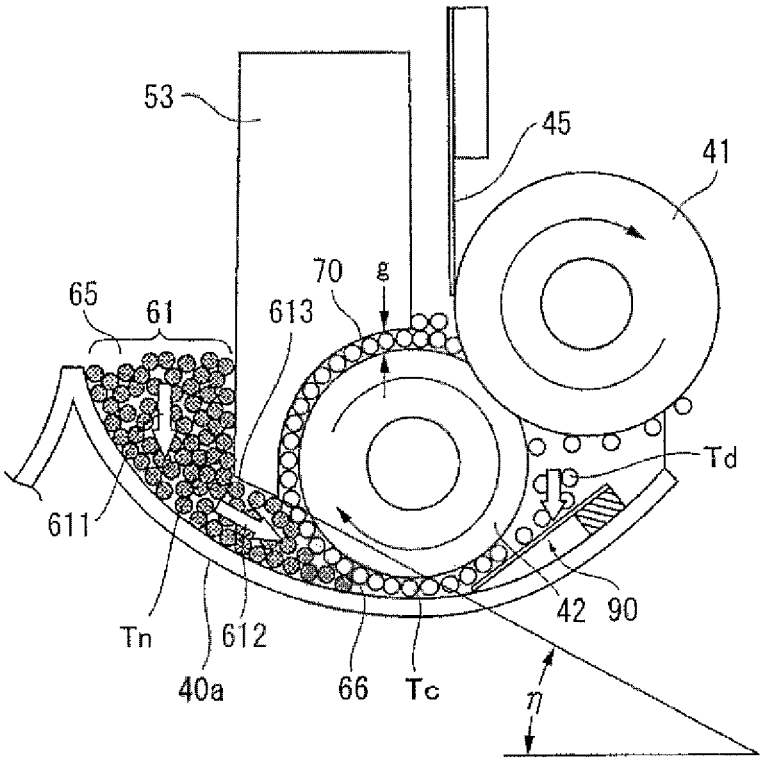
FIG. 13B is an explanatory diagram illustrating a detail of the B part shown in FIG. 13A.

In the present exemplary embodiment, the toner transporting path 61 is the same as that of Exemplary Embodiment 1 in that, as shown in FIGS. 13A and 13B, the developing chamber side opening 66 is disposed below the containing chamber side opening 65. However, the shape thereof is different from that of Exemplary Embodiment 1 in that there are provided a longitudinal passage 611, which extends in the longitudinal direction along the substantially vertical direction, and a lateral passage 612 which is bent from the longitudinal passage 611 and extends in the lateral direction toward the supplying roller 42.

In the present example, as the height of the longitudinal passage 611 increases, the pressure, applied to the circumferential surface of the supplying roller 42 at the interface (as a wall) by the toner remaining portion of the new toner Tn, increases. Further, as the width of the cross section of the shape of the longitudinal passage 611 becomes larger on the upper side, the capacity of the new toner Tn filled in the longitudinal passage 611 becomes larger. Thus, even in such a configuration, it is possible to increase the pressure applied by the toner remaining portion of the new toner Tn at the interface.

Further, the lateral passage 612 is curved and extends in a desired direction from the longitudinal passage 611 such that the interface is formed by the toner remaining portion of the new toner Tn at the portion opposed to the circumferential surface of the supplying roller 42.

Further, the toner transporting path 61 is formed to be partitioned between the partitioning member 53 and a curved portion 40*a* which is a part of the bottom wall of the development container 40, but the upper wall of the partitioning member 53, which partitions the upper side of the lateral passage 612, is inclined obliquely downward from the longitudinal passage 611 toward the supplying roller 42, and the inclination angle η to the lateral direction is set to be equal to or less than the angle of repose of the used toner.

Here, the angle of repose of the toner is an indicator representing the fluidity. In the present configuration, the inclination angle η of the upper wall of the lateral passage 612 is set to be equal to or less than the angle of repose of the toner in the lateral direction. Hence, correspondingly, the toner particles in the toner remaining portion of the new toner Tn filled in the lateral passage 612 are unlikely to flow, and there is an effect to relax the excess pressure from the longitudinal passage 611. Thus, it is possible to adjust the supply pressure applied to the supplying roller 42 of the new toner Tn on the basis of the combination between the inclination angle η, the length of the lateral passage 612, and the height of the longitudinal passage 611.

Furthermore, in the present exemplary embodiment, the bend portion 613 of the partitioning member 53 between the longitudinal passage 611 and the lateral passage 612 is formed in a shape having a corner. However, in terms of minimizing the moving resistance of the new toner Tn which remains in the range from the longitudinal passage 611 to the lateral passage 612, the bend portion 613 may be formed in a curved shape.

EXAMPLES

Example 1

The present example embodies the developing device (FIGS. 3 to 7) according to Exemplary Embodiment 1, and evaluates the supplying capability of the new toner and the mixture prevention abilities of the old and new toners by setting the entering position, at which the new toner enters from the developing chamber side opening of the toner transporting path to the supplying roller of the new toner, to be horizontal (0°) with respect to the supplying roller.

Here, in the evaluation of the performance of the developing device according to Example 1, it is assumed that the configurations in which the entering position of the new toner to the supplying roller is appropriately changed (specifically, the entering position is set to be obliquely upward at an angle of 21° with respect to the horizontal direction, obliquely upward 50° with respect to the horizontal direction, and obliquely upward 86° with respect to the horizontal direction) are Comparative Examples 1 to 3, and evaluation is performed in the same manner as Example 1. In addition, any one of Comparative Examples 1 to 3 has a layout in which the developing chamber side opening of the toner transporting path is opposed to the region above the center position of the supplying roller.

The configuration conditions of the components of each of the example and Comparative Examples 1 to 3 are as follows.

Development roller which has a silicone rubber layer formed around the shaft of ϕ 5 mm, has ϕ 12 mm, and has a surface roughness Ra of 1.2 μm.

Supplying roller which has a urethane foam sponge rubber layer formed around the shaft of ϕ 5 mm, has ϕ 11 mm, has an average cell diameter of 300 μm, and has an Asker C hardness of 20.

Applied voltages (developing voltage, supplying voltage) of DC −160V which are applied to all the developing roller and supplying roller.

Charging blade material which is made of stainless with a plate thickness of 0.08 mm and has a linear pressure of 40 mN/mm (≅4 gf/mm).

Toner which is a negatively charged toner with an average grain diameter of 6.5 μm manufactured by emulsion polymerization.

Evaluation about the supplying capability ('supplying ability' in FIG. 14) of the new toner and the mixture prevention abilities ('mixture prevention' in FIG. 14) of the old and new toners is performed as follows. In the developing devices according to Example 1 and Comparative Examples 1 to 3, first, a M-color (magenta) toner is filled in the developing chamber of the development container, an idle drive is performed, a normal state is achieved, thereafter C-color (cyan) toner is injected into the containing chamber, thereby outputting a beta image on the entire surface. Subsequently, the C-color density and the M-color density are measured from the output image sample by the densitometer, and are determined on the basis of the ratio of used old and new toners, which are provided for development, from the respective color density. It should be noted that, in the present example, the new toner Tn is the C-color toner, and the old toner Tc is the M-color toner.

Figure 14:
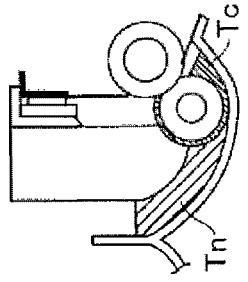
FIG. 14 is an explanatory diagram illustrating evaluations of performances of the developing devices according to Example 1 and Comparative Examples 1 to 3.
Figure 14:
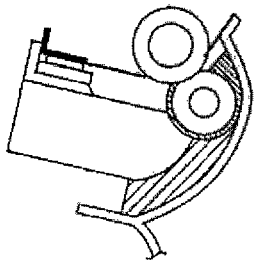
Figure 14:
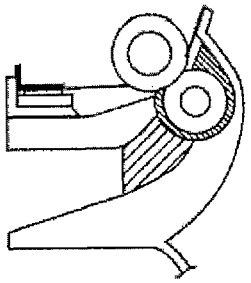
Figure 14:
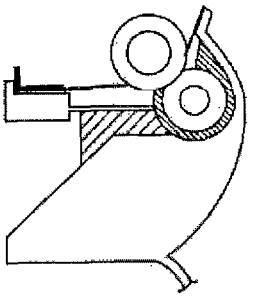

The results are shown in FIG. 14.

Although favorable results in the supplying capability of the new toner may be obtained through the entire casing, in terms of preventing the old and new toners from being mixed, except Example 1, the mixture prevention, that is, the tendency to increase the mixture between the old and new toners is observed. The reason is considered that the new toner Tn (C-color toner) forms a wall along the circumferential surface of the supplying roller by its own weight, but the old toner Tc (M-color toner: first-in toner) on the developing chamber side is transported from the lower side to the upper side in the region corresponding to a upper half of the supplying roller along the new toner wall, and then the new toner on the circumferential surface of the supplying roller tends to be drawn by the rotation of the supplying roller.

Accordingly, as shown in Example 1, it is preferable that the new toner within the toner transporting path enter toward the supplying roller from the substantially lateral direction. As one configuration thereof, it is preferable to adopt a configuration in which the developing chamber side opening of the toner transporting path is provided below the center position of the supplying roller.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a toner holding member that is rotatably provided to face an image holding member, which circulates while holding an electrostatic latent image, and holds and transports a nonmagnetic single-component toner toward a development region, which is opposed to the image holding member, so as to develop the electrostatic latent image on the image holding member;

a supplying member that has a rough surface, on which the toner may be captured, on a circumferential surface of an elastic member which is elastically deformable, and is rotatably provided in elastic contact with the toner holding member so as to supply the toner from a contact region, which comes into contact with the toner holding member, to the toner holding member;

a toner replenishing unit that contains new toner and faces a replenishment region at a portion apart from the contact region of the supplying member, which comes into contact with the toner holding member, so as to replenish the toner; and a regulating member that is provided on a downstream side of the contact region, which comes into contact with the supplying member, in the toner holding member in a rotation direction thereof and on an upstream side of the development region of the toner holding member in a rotation direction thereof so as to triboelectrically charge the toner held on the toner holding member and regulate the amount of toner provided for the development, wherein in the toner replenishing unit, a containing chamber, which contains the new toner such that the toner may be replenished, is connected to a developing chamber, in which the supplying member and the toner holding member are disposed, through a toner transporting path, wherein a developing chamber side opening of the toner transporting path is positioned below a containing chamber side opening of the toner transporting path, and is disposed to face a region under a rotation center of the supplying member, and wherein the supplying member rotates from a down side thereof toward an upper side thereof at a portion facing the developing chamber side opening of the toner transporting path.

2. The developing device according to claim 1, wherein a lower end of the containing chamber side opening of the toner transporting path is positioned below a portion in which the toner is regulated by the regulating member.

3. The developing device according to claim 2, wherein the toner transporting path has a longitudinal passage, which extends in a longitudinal direction along a substantially vertical direction, and a lateral passage which is bent from the longitudinal passage and extends in the lateral direction toward the supplying member.

4. The developing device according to claim 3, wherein in the toner transporting path, a bend portion from the longitudinal passage to the lateral passage is formed in a curved shape.

5. The developing device according to claim 4, wherein the toner transporting path and the containing chamber are divided by a first division member, the toner transporting path and the developing chamber are divided by a second division member, and the toner transporting path is formed between both of the first and the second division members.

6. The developing device according to claim 3, wherein in the toner transporting path, an upper wall, which partitions an upper side of the lateral passage, is inclined obliquely downward from the longitudinal passage toward the supplying member, and an inclination angle to the lateral direction is set to be equal to or less than an angle of repose of a used toner.

7. The developing device according to claim 6, wherein the toner transporting path and the containing chamber are divided by a first division member, the toner transporting path and the developing chamber are divided by a second division member, and the toner transporting path is formed between both of the first and the second division members.

8. The developing device according to claim 3, wherein the toner transporting path and the containing chamber are divided by a first division member, the toner transporting path and the developing chamber are divided by a second division member, and the toner transporting path is formed between both of the first and the second division members.

9. The developing device according to claim 2, wherein the toner transporting path and the containing chamber are divided by a first division member, the toner transporting path and the developing chamber are divided by a second division member, and the toner transporting path is formed between both of the first and the second division members.

10. An image forming apparatus comprising:

an image holding member that circulates while holding an electrostatic latent image; and the developing device according to claim 2 that is disposed to face the image holding member and develops the electrostatic latent image on the image holding member.

11. The image forming apparatus according to claim 10, further comprising:

a control device that is able to control consumption of a toner of the developing device, wherein the control device comprises:

a calculating section which calculates an amount of toner consumed in a predetermined number of image formations;

a determining section which determines whether or not the amount of toner calculated in the calculating section is greater than or equal to a predetermined threshold value;

an ejecting section which ejects the toner within the developing device toward the image holding member by a predetermined amount when the amount of toner determined in the determining section is less than the threshold value; and a cleaning processing section that cleans the toner, which is ejected from the ejecting section, on the image holding member.

12. The developing device according to claim 1, wherein the toner transporting path has a longitudinal passage, which extends in a longitudinal direction along a substantially vertical direction, and a lateral passage which is bent from the longitudinal passage and extends in the lateral direction toward the supplying member.

13. The developing device according to claim 12, wherein in the toner transporting path, a bend portion from the longitudinal passage to the lateral passage is formed in a curved shape.

14. The developing device according to claim 13, wherein the toner transporting path and the containing chamber are divided by a first division member, the toner transporting path and the developing chamber are divided by a second division member, and the toner transporting path is formed between both of the first and the second division members.

15. The developing device according to claim 12, wherein in the toner transporting path, an upper wall, which partitions an upper side of the lateral passage, is inclined obliquely downward from the longitudinal passage toward the supplying member, and an inclination angle to the lateral direction is set to be equal to or less than an angle of repose of a used toner.

16. The developing device according to claim 12, wherein the toner transporting path and the containing chamber are divided by a first division member, the toner transporting path and the developing chamber are divided by a second division member, and the toner transporting path is formed between both of the first and the second division members.

17. The developing device according to claim 15, wherein the toner transporting path and the containing chamber are divided by a first division member, the toner transporting path and the developing chamber are divided by a second division member, and the toner transporting path is formed between both of the first and the second division members.

18. The developing device according to claim 1, wherein the toner transporting path and the containing chamber are divided by a first division member, the toner transporting path and the developing chamber are divided by a second division member, and the toner transporting path is formed between both of the first and the second division members.

19. An image forming apparatus comprising:

an image holding member that circulates while holding an electrostatic latent image; and the developing device according to claim 1 that is disposed to face the image holding member and develops the electrostatic latent image on the image holding member.

20. The image forming apparatus according to claim 19, further comprising:

a control device that is able to control consumption of a toner of the developing device, wherein the control device comprises:

a calculating section which calculates an amount of toner consumed in a predetermined number of image formations;

a determining section which determines whether or not the amount of toner calculated in the calculating section is greater than or equal to a predetermined threshold value;

an ejecting section which ejects the toner within the developing device toward the image holding member by a predetermined amount when the amount of toner determined in the determining section is less than the threshold value; and a cleaning processing section that cleans the toner, which is ejected from the ejecting section, on the image holding member.

* * * * *